US009093011B2

(12) United States Patent
Igawa

(10) Patent No.: US 9,093,011 B2
(45) Date of Patent: Jul. 28, 2015

(54) METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

(71) Applicant: SAMSUNG DISPLAY CO., LTD., Gyeonggi-do (KR)

(72) Inventor: Masami Igawa, Suwon-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 219 days.

(21) Appl. No.: 13/709,466

(22) Filed: Dec. 10, 2012

(65) Prior Publication Data

US 2014/0028731 A1 Jan. 30, 2014

(30) Foreign Application Priority Data

Jul. 24, 2012 (KR) ..... 10-2012-0080423

(51) Int. Cl.
*G09G 5/00* (2006.01)
*G09G 5/10* (2006.01)
*G09G 3/34* (2006.01)

(52) U.S. Cl.
CPC ..... *G09G 5/10* (2013.01); *G09G 3/3406* (2013.01)

(58) Field of Classification Search
CPC ..... G09G 3/3406
USPC ..... 345/690
See application file for complete search history.

(56) References Cited

U.S. PATENT DOCUMENTS

| | | | | |
|---|---|---|---|---|
| 7,298,358 | B2 | 11/2007 | Honbo | |
| 2007/0132712 | A1 | 6/2007 | Song | |
| 2009/0289962 | A1* | 11/2009 | Jun et al. | 345/690 |
| 2010/0295877 | A1* | 11/2010 | Yun | 345/690 |

FOREIGN PATENT DOCUMENTS

| | | | |
|---|---|---|---|
| KR | 1020080026278 | A | 3/2008 |
| KR | 1020110064089 | A | 6/2011 |

* cited by examiner

*Primary Examiner* — Amare Mengistu
*Assistant Examiner* — Joseph G Rodriguez
(74) *Attorney, Agent, or Firm* — F. Chau & Associates, LLC

(57) ABSTRACT

A light source apparatus includes a display panel luminance change storing part, a light source part and a light source driving part. The display panel luminance change data storing part stores a display panel luminance change data indicating a luminance change of a display panel with respect to time. The light source part provides a light to the display panel and outputs a light source luminance. The light source driving part drives the light source part based on the display panel luminance change data so that the light source luminance is decreased when a display panel luminance is increased and the light source luminance is increased when the display panel luminance is decreased. Thus, a display quality of a display apparatus may be enhanced.

14 Claims, 16 Drawing Sheets

METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

CROSS-REFERENCE TO RELATED APPLICATION

This application claims priority under 35 U.S.C. §119 to Korean Patent Application No 10-2012-0080423, filed on Jul. 24, 2012 in the Korean Intellectual Property Office (KIPO), the contents of which are herein incorporated by reference in their entireties.

TECHNICAL FIELD

Exemplary embodiments of the present invention relate to a method of driving a light source, a light source apparatus for performing the method and a display apparatus having the light source apparatus, and more particularly to a method of driving a light source used in a display apparatus, a light source apparatus for performing the method and a display apparatus having the light source apparatus.

DISCUSSION OF THE RELATED ART

A display panel of a display apparatus, such as a liquid crystal display apparatus and an electrophoretic display apparatus, includes pixel electrodes and a common electrode. A pixel voltage is applied to a pixel electrode and a common voltage is applied to the common electrode.

A first voltage applied to a pixel electrode may be leaked and thus may be decreased to a second voltage lower than the first voltage.

The display panel may have a first luminance when the pixel electrode has the first voltage and a second luminance different from the first luminance when the pixel electrode has the second voltage. Such difference in luminance of the display panel may be increased as the frequency of a vertical start signal decreases, so that the display panel may flicker, thus resulting in a deterioration of the display quality.

SUMMARY

According to an exemplary embodiment of the present invention, there is a provided a method of driving a light source. In the method, a display panel luminance change data indicating a luminance change of a display panel with respect to time is stored. A light source driving signal driving a light source part is outputted based on the display panel luminance change data so that a light source luminance outputted from the light source part is decreased when a display panel luminance is increased and the light source luminance is increased when the display panel luminance is decreased. The light source part is driven in response to the light source driving signal. The light source part outputs a light to the display panel.

In an embodiment, the display panel luminance change data or a dimming data is read from a storing element to output a dimming signal controlling a luminance of the light source part. The dimming data may be converted from a data opposite to the display panel luminance change data by a pulse width modulation.

In an embodiment, the dimming signal may be further converted to output an analog dimming signal. The dimming signal may be a digital signal. The light source driving signal is outputted by converting the analog dimming signal to the light source driving signal.

In an embodiment, the light source driving signal may be outputted by converting the dimming signal to the light source driving signal. A first period during which the light source part generates light having a first luminance may be increased as a level of the display panel luminance change data is decreased, and a second period during which the light source part generates light having a second luminance less than the first luminance may be increased as a level of the display panel luminance change data is increased.

In an embodiment, the display panel may be in a normally white mode. The display panel luminance change data may have a first level when a first voltage is applied to a pixel electrode of the display panel, the display panel luminance change data may have a second level higher than the first level when a second voltage lower than the first voltage is applied to the pixel electrode of the display panel, the light source luminance may have a third level when the display panel luminance change data has the first level, and the light source luminance may have a fourth level lower than the third level when the display panel luminance change data has the second level.

In an embodiment, a difference between the first level and the second level may be substantially the same as a difference between the third level and the fourth level.

In an embodiment, the display panel may be in a normally black mode, the display panel luminance change data may have a fifth level when a first voltage is applied to a pixel electrode of the display panel, the display panel luminance change data may have a sixth level lower than the fifth level when a second voltage lower than the first voltage is applied to the pixel electrode of the display panel, the light source luminance may have a seventh level when the display panel luminance change data has the fifth level, and the light source luminance may have an eighth level higher than the seventh level when the display panel luminance change data has the sixth level.

In an embodiment, a difference between the fifth level and the sixth level may be substantially the same as a difference between the seventh level and the eighth level.

In an embodiment, the display panel may display an image in response to a vertical start signal having a first period, and the first period may include a scanning period during which a frame of image data displayed by the display panel is scanned and a standby period during which the frame of the image data is not scanned.

In an embodiment, at least one of the display panel luminance change data or a light source luminance change indicating the light source luminance may have the first period.

In an embodiment, the luminance of the display panel may be a luminance at a central portion of the display panel or an average luminance in the display panel.

In an embodiment, a waveform of the display panel luminance change data and a waveform of a light source luminance change indicating the light source luminance have portions substantially symmetric from each other.

In an embodiment, when the light source part controls the display panel per a block, the display panel luminance change data may indicate a luminance of central portions of respective blocks.

In an embodiment, the display panel luminance change data may be stored per the display panel.

According to an exemplary embodiment of the present invention, a light source apparatus includes a display panel luminance change storing part, a light source part and a light source driving part. The display panel luminance change data storing part stores a display panel luminance change data indicating a luminance change of a display panel with respect to time. The light source part provides a light to the display panel and outputs a light source luminance. The light source driving part drives the light source part based on the display panel luminance change data so that the light source luminance is decreased when a display panel luminance is increased and the light source luminance is increased when the display panel luminance is decreased.

In an embodiment, the light source apparatus may further include a dimming data storing part storing a dimming data. The dimming data may be converted from a data opposite to the display panel luminance change data by a pulse width modulation.

In an embodiment, the light source apparatus may further include a timing control part reading the display panel luminance change data or the dimming data to output a dimming signal controlling a luminance of the light source part.

In an embodiment, the dimming signal may be a digital signal and the light source driving part may include a digital/analog converting part converting the dimming signal to an analog dimming signal to output the analog dimming signal.

In an embodiment, the light source driving part may include a light source driving signal generating part converting the analog dimming signal to the light source driving signal to generate the light source driving signal.

In an embodiment, the light source driving part may include a switch operating in response to the dimming signal, a first voltage terminal selectively connected to the light source part through the switch by the dimming signal, and a second voltage terminal selectively connected to the light source part through the switch by the dimming signal. The first voltage terminal may receive a first voltage. The second voltage terminal may receive a second voltage different from the first voltage.

In an embodiment, the light source part may include a light source generating the light, a switch electrically connected to the light source and operating in response to the light source driving signal, a first resistor selectively connected to the light source through the switch by the light source driving signal, and a second resistor selectively connected to the light source through the switch by the light source driving signal. The second resistor may have a resistance different from a resistance of the first resistor.

In an embodiment, the light source apparatus may further include an operation part and a timing control part. The operation part may receive the display panel luminance change data to calculate a digital control signal in response to a luminance change of the display panel. The timing control part may output the digital control signal.

In an embodiment, the display panel luminance change data storing part may receive the display panel luminance change data to have a timing data generated by modulating the display panel luminance change data using a pulse width modulation.

According to an exemplary embodiment of the present invention, a display apparatus includes a display panel and a light source apparatus. The display panel displays an image. The light source apparatus includes a display panel luminance change data storing part configured to store a display panel luminance change data indicating a luminance change of a display panel with respect to time, a light source part configured to providing light to the display panel and configured to output a light source luminance, and a light source driving part configured to drive the light source part based on the display panel luminance change data so that the light source luminance is decreased when a display panel luminance is increased and the light source luminance is increased when the display panel luminance is decreased.

According to an exemplary embodiment of the present invention, there is provided a method of driving a light source of a display panel, the method including generating a panel luminance signal, wherein a level of the panel luminance signal changes depending on a luminance of the display panel, generating a dimming signal based on the panel luminance signal, wherein as the level of the panel luminance signal increases, a high level period of the dimming signal decreases and a low level period of the dimming signal increases, and providing light from the light source to the display panel in response to the dimming signal.

According to the embodiments of the present invention, a luminance difference of a display panel is decreased, although the display panel is driven by a vertical start signal having a low frequency, and thus a flicker may be prevented from being generated. Thus, the display quality of a display apparatus including the display panel may be enhanced.

BRIEF DESCRIPTION OF THE DRAWINGS

The embodiments of the present invention will become more apparent by the description thereof with reference to the accompanying drawings, in which.

DETAILED DESCRIPTION

Figure 1:
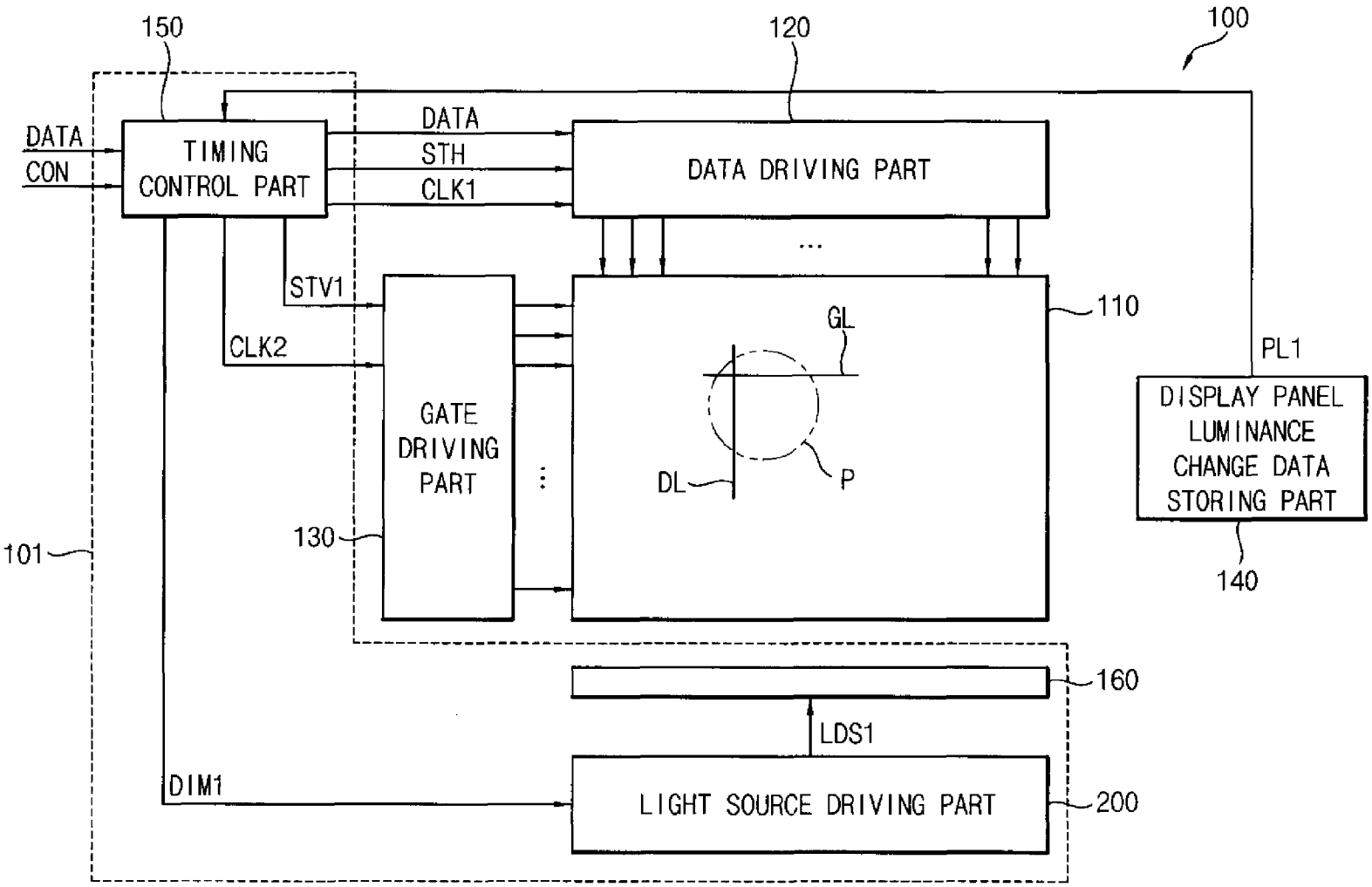
FIG. 1 is a block diagram illustrating a display apparatus according to an exemplary embodiment of the present invention.

Hereinafter, embodiments of the present invention will be described in detail with reference to the accompanying drawings, wherein the same reference numerals may be used to denote the same or substantially the same elements throughout the specification and the drawings.

It will be understood that when an element or layer is referred to as being "on," "connected to" or "coupled to" another element or layer, it can be directly on, connected or coupled to the other element or layer or intervening elements or layers may be present.

As used herein, the singular forms, "a," "an" and "the" are intended to include the plural forms as well, unless the context clearly indicates otherwise.

FIG. 1 is a block diagram illustrating a display apparatus according to an exemplary embodiment of the present invention.

Referring to FIG. 1, the display apparatus 100 according to an exemplary embodiment includes a display panel 110, a data driving part 120, a gate driving part 130, display panel luminance change data storing part 140 and a light source apparatus 101. The light source apparatus 101 includes a timing control part 150, a light source part 160 and a light source driving part 200.

The display panel 110 receives image data DATA to display an image. The display panel 110 includes a plurality of gate lines GL, a plurality of data lines DL and a plurality of pixels P. For example, according to an embodiment, the display panel 110 may include M*N pixels P, where each of M and N is a natural number. Each of the pixels P includes a thin-film transistor electrically connected to a gate line GL and a data line DL, a liquid crystal capacitor and a storage capacitor connected to the thin-film transistor. According to an embodiment, the display panel 110 may include pixel electrodes, a common electrode facing the pixel electrodes, and a liquid crystal layer interposed between the pixel electrodes and the common electrode. According to an embodiment, the display panel 110 may have a normally white mode, so that the display panel 110 may be in a full white state when pixel voltages are not applied to the pixel electrodes.

The timing control part 150 receives the image data DATA and control signals CON from an outside source. The control signals CON may include a horizontal synchronous signal Hsync, a vertical synchronous signal Vsync, and a clock signal.

The timing control part 150 generates a horizontal start signal STH using the horizontal synchronous signal Hsync and outputs the horizontal start signal STH to the data driving part 120. The timing control part 150 generates a vertical start signal STV1 using the vertical synchronous signal Vsync and outputs the vertical start signal STV1 to the gate driving part 130. According to an embodiment, the vertical start signal STV1 may have a frequency of about 30 hertz (HZ). The timing control part 150 generates a first clock signal CLK1 and a second clock signal CLK2 using the clock signal and outputs the first clock signal CLK1 to the data driving part 120 and the second clock signal CLK2 to the gate driving part 130.

The timing control part 150 outputs a dimming signal DIM1 that controls the luminance of the light source part 160. The timing control part 150 reads a display panel luminance change data PL1 from the display panel luminance change data storing part 140 and outputs the dimming signal DIM1 to the light source driving part 200 based on the display panel luminance change data PL1 so that a light source luminance indicating a luminance of the light source part 160 is opposite to a display panel luminance indicating a luminance of the display panel 110. Thus, the timing control part 150 controls the light source driving part 200 so that a waveform of the display panel luminance change data PL1 is opposite to a waveform of a light source luminance change indicating the luminance of the light source part 160.

The data driving part 120 outputs the image data DATA to the data lines DL in response to the first clock signal CLK1 and the horizontal start signal STH provided from the timing control part 150.

The gate driving part 130 generates gate signals using the vertical start signal STV1 and the second clock signal SLK2 provided from the timing control part 150 and outputs the gate signals to the gate lines GL.

The display panel luminance change data storing part 140 stores the display panel luminance change data PL1 indicating a change of the display panel luminance with respect to time or indicating a luminance of the display panel 110, and outputs the display panel luminance change data PL1 to the timing control part 150. According to an embodiment, the display panel luminance change data PL1 may indicate a luminance of a central portion of the display panel 110. Alternatively, the display panel luminance change data PL1 may indicate an average luminance in the display panel 110.

The light source part 160 is driven in response to the light source driving signal LDS1 outputted from the light source driving part 200 and provides light to the display panel 110. For example, according to an embodiment, the light source part 160 may be disposed at a side of the display panel 110. Alternatively, the light source part 160 may be disposed under the display panel 110.

The light source driving part 200 receives the dimming signal DIM1 outputted from the timing control part 150 and outputs the light source driving signal LDS1 to the light source part 160 based on the dimming signal DIM1.

Figure 2:
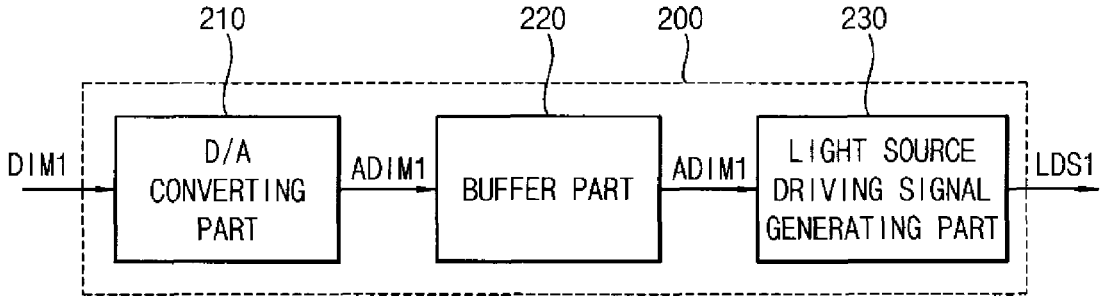
FIG. 2 is a block diagram illustrating the light source driving part of FIG. 1.

FIG. 2 is a block diagram illustrating the light source driving part 200 of FIG. 1.

Referring to FIGS. 1 and 2, the light source driving part 200 includes a digital/analog converting part 210, a buffer part 220 and a light source driving signal generating part 230.

The digital/analog converting part 210 receives the dimming signal DIM1 from the timing control part 150. According to an embodiment, the dimming signal DIM1 may be a digital signal. For example, according to an embodiment, the dimming signal DIM1 may be a pulse width modulation (PWM) signal. The digital/analog converting part 210 converts the dimming signal DIM1 to an analog dimming signal ADIM1 and outputs the analog dimming signal ADIM1 to the buffer part 220. According to an embodiment, the analog dimming signal ADIM1 may be a voltage signal. The buffer part 220 buffers the analog dimming signal ADIM1.

The light source driving signal generating part 230 receives the analog dimming signal ADIM1 from the buffer part 220 and converts the analog dimming signal ADIM1 to the light source driving signal LDS1 and outputs the light source driving signal LDS1 to the light source part 160. According to an embodiment, the light source driving signal LDS1 may be a current signal.

Figure 3:
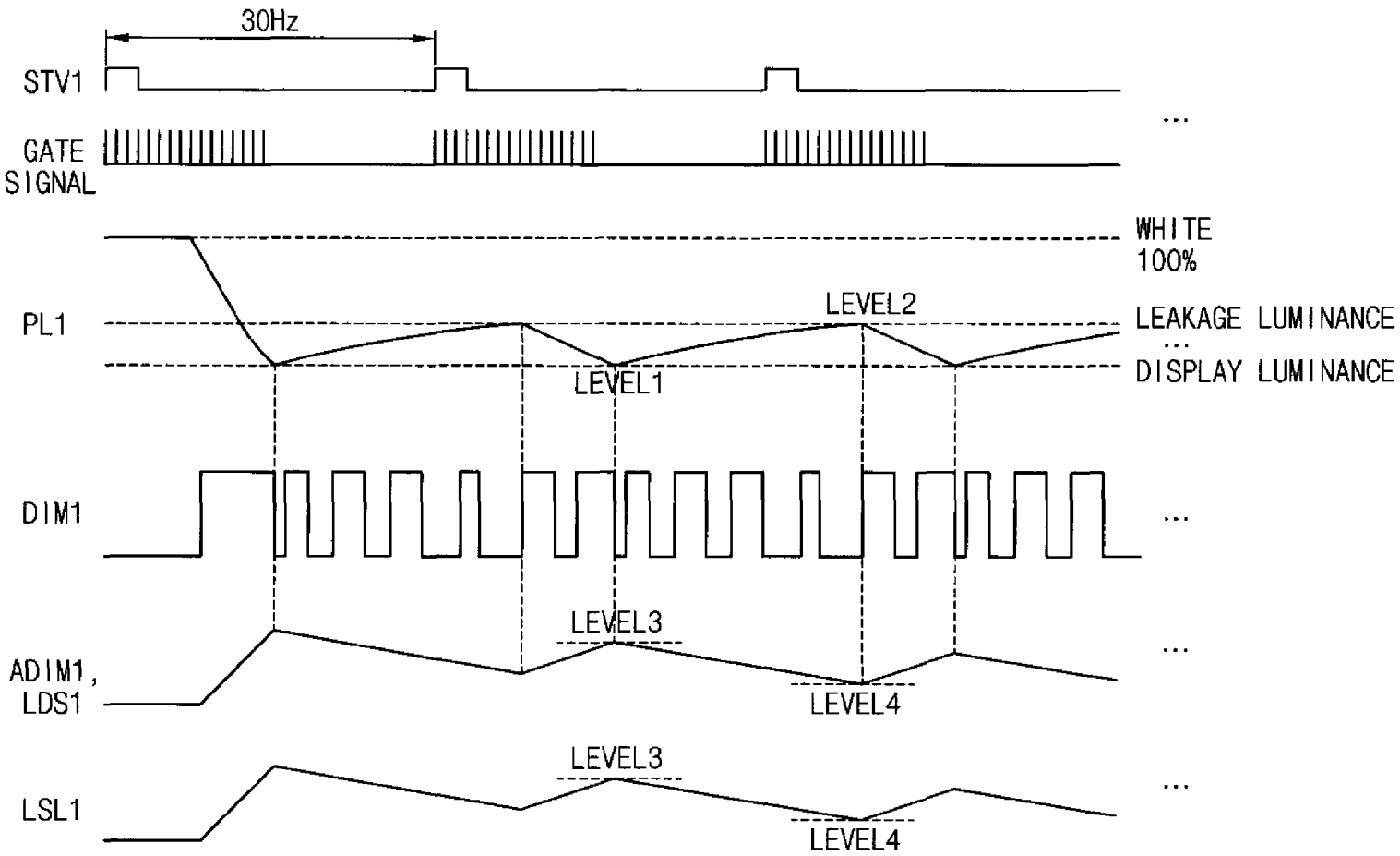
FIG. 3 is a waveform diagram illustrating a vertical start signal, a display panel luminance change data, a dimming signal, an analog dimming signal and a light source driving signal as shown in FIGS. 1 and 2.

FIG. 3 is a waveform diagram illustrating the vertical start signal STV1, the display panel luminance change data PL1, the dimming signal DIM1, the analog dimming signal ADIM1 and the light source driving signal LDS1 of FIGS. 1 and 2.

Referring to FIGS. 1 to 3, the vertical start signal STV1 has a first period. The first period includes a scanning period during which a frame of the image data DATA displayed by the display panel 110 is scanned and a standby period during which the frame of the image data DATA is not scanned. For example, according to an embodiment, the vertical start signal STV1 may have a frequency of about 30 Hz, and the frame of the image data DATA may have a frequency of about 60 Hz. The gate signal is applied to the gate line GL during a half of the period between two vertical starts signals STV1 adjacent to each other.

According to an embodiment, the display panel 110 is in a normally white mode. Thus, the display panel luminance change data PL1 may have a first level LEVEL1 when a first voltage is applied to the pixel electrode of the display panel 110 and the display panel luminance change data PL1 may have a second level LEVEL2 higher than the first level LEVEL1 when a second voltage lower than the first voltage is applied to the pixel electrode of the display panel 110. For example, according to an embodiment, the first voltage may be a pixel voltage applied to the pixel electrode without a voltage leakage, and the pixel voltage is reduced by a leakage voltage, thus resulting in the second voltage.

A waveform of the light source luminance change LSL1 indicating the luminance of the light source part 160 is opposite to a waveform of the display panel luminance change data PL1. For example, the light source luminance change LSL1 is decreased as the display panel luminance change data PL1 is increased, and the light source luminance change LSL1 is increased as the display panel luminance change data PL1 is decreased. The light source luminance change LSL1 has a third level LEVEL3 when the display panel luminance change data PL1 has the first level LEVEL1, and the light source luminance change LSL1 has a fourth level LEVEL4 lower than the third level LEVEL3 when the display panel luminance change data PL1 has the second level LEVEL2 higher than the first level LEVEL1.

The light source driving signal LDS1 and the analog dimming signal ADIM1 are signals for driving the light source part 160, and thus each of the waveforms of the light source driving signal LDS1 and the analog dimming signal ADIM1 is substantially the same as the waveform of the light source luminance change LSL1. Thus, each of the light source driving signal LDS1 and the analog dimming signal ADIM1 has the third level LEVEL3 when the display panel luminance change data PL1 has the first level LEVEL1, and each of the light source driving signal LDS1 and the analog dimming signal ADIM1 has the fourth level LEVEL4 lower than the third level LEVEL3 when the display panel luminance change data PL1 has the second level LEVEL2 higher than the first level LEVEL1.

Each of the waveforms of the light source driving signal LDS1, the analog diming signal ADIM1 and the light source luminance change LSL1 is opposite to the waveform of the display panel luminance change data PL1, and thus each of the waveforms of the light source driving signal LDS1, the analog diming signal ADIM1 and the light source luminance change LSL1 has a portion symmetric or substantially symmetric with the waveform of the display panel luminance change data PL1. Thus, a difference between the first level LEVEL1 and the second level LEVEL2 of the display panel luminance change data PL1 is substantially the same as a difference between the third level LEVEL3 and the fourth level LEVEL4 of the light source driving signal LDS1, the analog diming signal ADIM1 and the light source luminance change LSL1.

A low level period of the dimming signal DIM1 is increased and a high level period of the dimming signal DIM1 is decreased so that the analog dimming signal ADIM1 is decreased as the display panel luminance change data PL1 is increased, and the low level period of the dimming signal DIM1 is decreased and the high level period of the dimming signal DIM1 is increased so that the analog dimming signal ADIM1 is increased as the display panel luminance change data PL1 is decreased.

Figure 4:
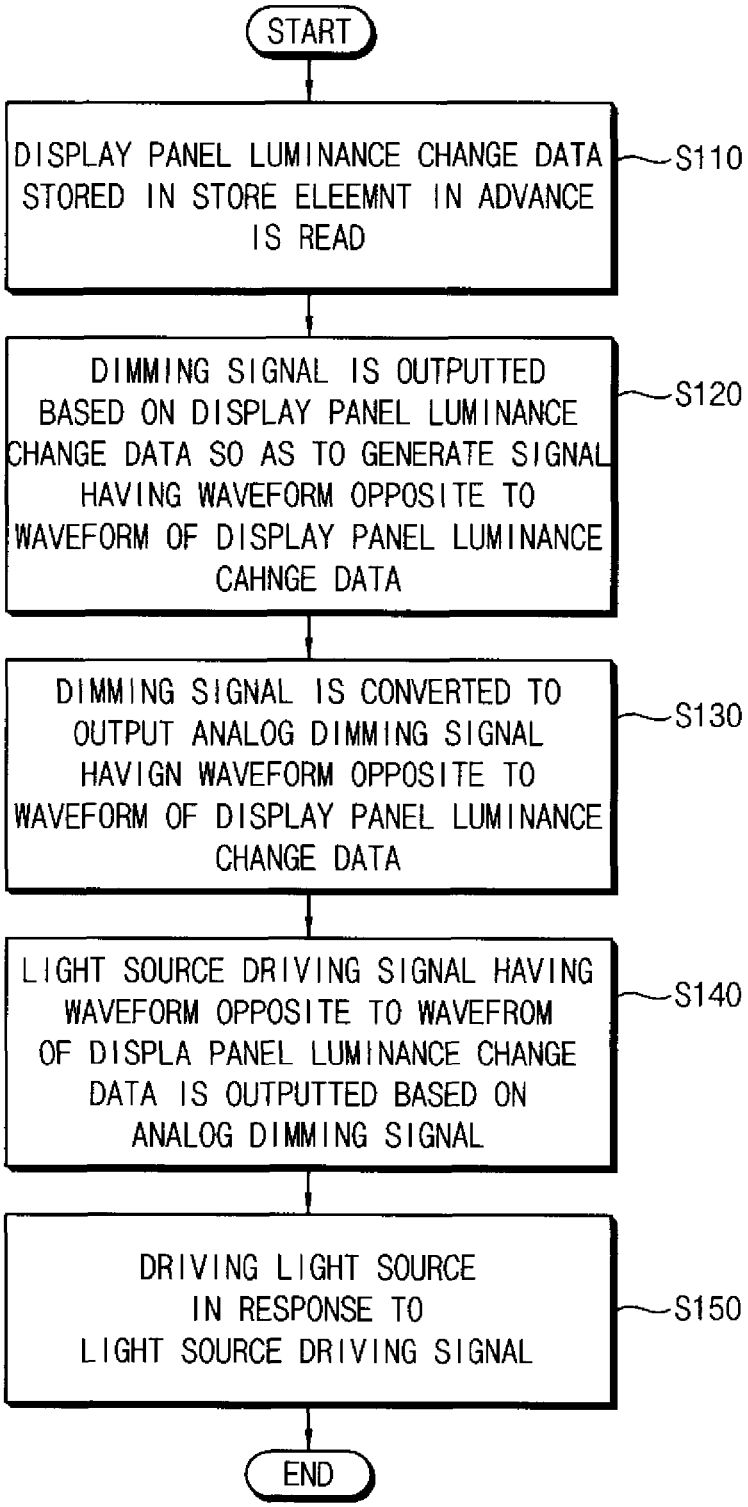
FIG. 4 is a flow chart illustrating a method of driving a light source by a light source apparatus of FIG. 1.

FIG. 4 is a flowchart illustrating a method of driving a light source by the light source apparatus 101 of FIG. 1.

Referring to FIGS. 1 to 4, the display panel luminance change data PL1 indicating the luminance of the display panel 110 is stored using the display panel luminance change data storing part 140, and the display panel luminance change data PL1 is read from the display panel luminance change data storing part 140 (step S110). The display panel 110 displays the image data DATA in response to the vertical start signal STV1. According to an embodiment, the vertical start signal STV1 has a frequency of about 30 Hz. According to an embodiment, the display panel 110 is in a normally white mode. Thus, the display panel luminance change data PL1 has the first level LEVEL1 when the first voltage is applied to the pixel electrode of the display panel 110, and the display panel luminance change data PL1 has the second level LEVEL2 higher than the first level LEVEL1 when the second voltage lower than the first voltage is applied to the pixel electrode of the display panel 110.

The dimming signal DIM1 is outputted based on the display panel luminance change data PL1 (step S120). The timing control part 150 outputs the dimming signal DIM1 based on the display panel luminance change data PL1 so that the waveform of the light source luminance change LSL1 indicating the luminance of the light source part 160 is opposite to the waveform of the display panel luminance change data PL1. According to an embodiment, the dimming signal DIM1 may be a pulse width modulation (PWM) signal. The low level period of the dimming signal DIM1 is increased and the high level period of the dimming signal DIM1 is decreased so that the analog dimming signal ADIM1 is decreased as the display panel luminance change data PL1 is increased, and the low level period of the dimming signal DIM1 is decreased and the high level period of the dimming signal DIM1 is increased so that the analog dimming signal ADIM1 is increased as the display panel luminance change data PL1 is decreased.

The diming signal DIM1 is converted to the analog dimming signal ADIM1, and the converted analog dimming signal ADIM1 is output (step S130). The analog dimming signal ADIM1 is decreased as the display panel luminance change data PL1 is increased, and the analog dimming signal ADIM1 is increased as the display panel luminance change data PL1 is decreased according to the dimming signal DIM1. Thus, the waveform of the analog dimming signal ADIM1 is opposite to the waveform of the display panel luminance change data PL1. According to an embodiment, the analog dimming signal ADIM1 may be a voltage signal.

The light source driving signal LDS1 is outputted based on the analog dimming signal ADIM1 (step S140). The waveform of the light source driving signal LDS1 is substantially the same as the waveform of the analog dimming signal ADIM1. Thus, the waveform of the light source driving signal LDS1 is opposite to the waveform of the display panel luminance change data PL1. According to an embodiment, the light source driving signal LDS1 may be a current signal.

The light source part 160 is driven in response to the light source driving signal LDS1 (step S150). The light source part 160 generates light and provides the light to the display panel 110. The waveform of the light source luminance change LSL1 indicating the luminance of the light source part 160 is substantially the same as the waveform of the light source driving signal LDS1. Thus, the waveform of the light source luminance change LSL1 indicating the luminance of the light source part 160 is opposite to the waveform of the display panel luminance change data PL1.

According to an exemplary embodiment, the light source part 160 is driven so that the waveform of the light source luminance change LSL1 indicating the luminance of the light source part 160 is opposite to the waveform of the display panel luminance change data PL1 indicating the luminance of the display panel 110. Therefore, a luminance difference of the display panel 110 is decreased, although the display panel 110 is driven by the vertical start signal STV1 having a low frequency, such as about 30 Hz, and thus a flicker is prevented from being generated. Thus, the display quality of the display apparatus 100 may be enhanced.

Figure 5:
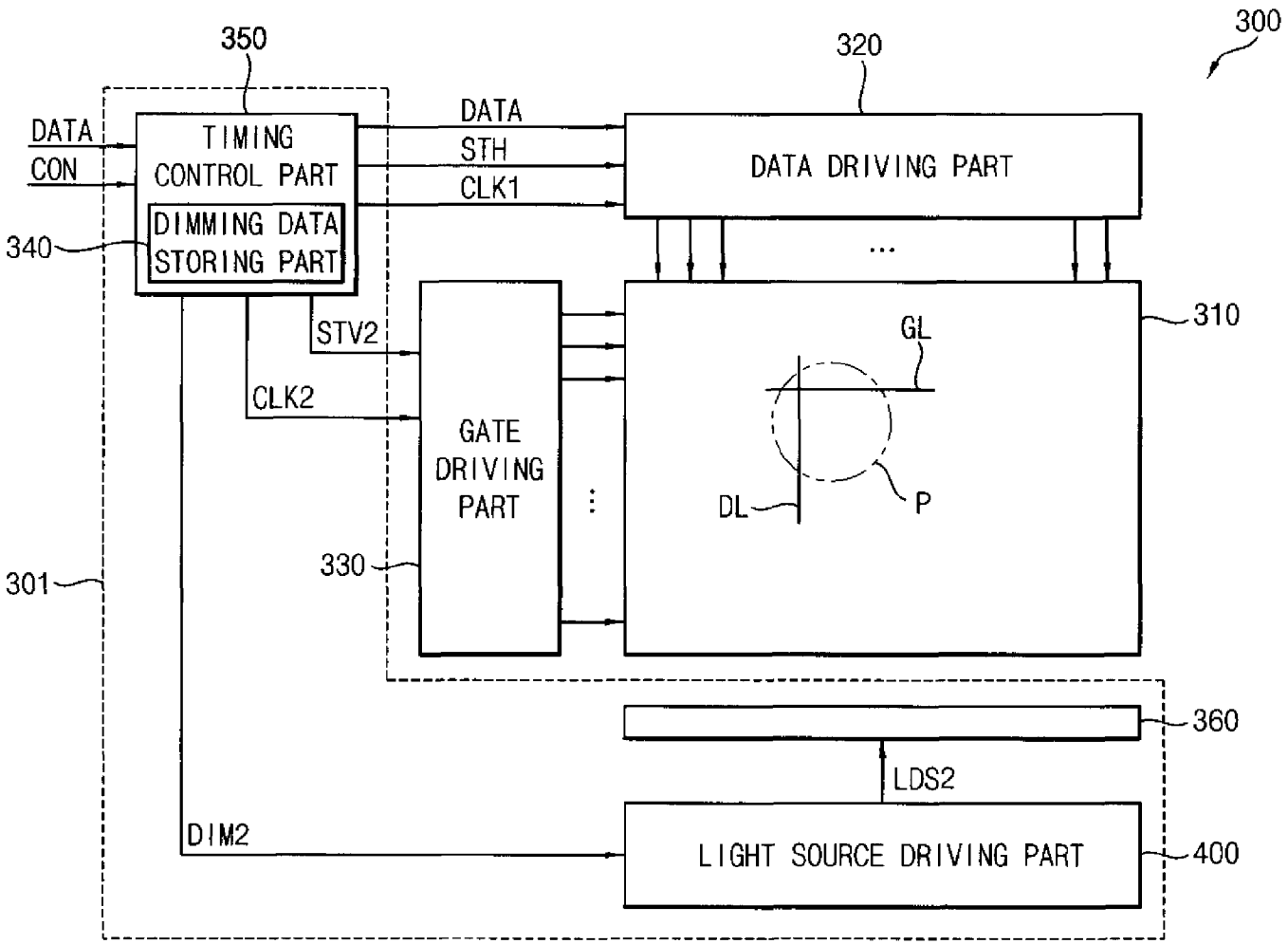
FIG. 5 is a block diagram illustrating a display apparatus according to an exemplary embodiment of the present invention.

FIG. 5 is a block diagram illustrating a display apparatus according to an exemplary embodiment of the present invention.

Referring to FIG. 5, the display apparatus 300 according to an exemplary embodiment includes a display panel 310, a data driving part 320, a gate driving part 330 and a light source apparatus 301. The light source apparatus 301 includes, a timing control part 350, a light source part 360 and a light source driving part 400, and the timing control part 350 includes a dimming data storing part 340. The dimming data storing part 340 stores a display panel surface average luminance change dimming data of the display panel 310. Thus, the dimming data storing part 340 may be a display panel surface average luminance change dimming data storing part.

According to an embodiment, the display panel 310 is substantially the same as the display panel 110 of FIG. 1 except that signals generated from the display panel 310 may be different from signals generated from the display panel 110.

The timing control part 350 receives image data DATA and a control signal CQN from an outside source. The control signal CON may include a horizontal synchronous signal Hsync, a vertical synchronous signal Vsync and a clock signal.

The timing control part 350 generates a horizontal start signal STH using the horizontal synchronous signal Hsync and outputs the horizontal start signal STH to the data driving part 320. The timing control part 350 generates a vertical start signal STV2 using the vertical synchronous signal Vsync and outputs the vertical start signal STV2 to the gate driving part 330. According to an embodiment, the vertical start signal STV2 may have a frequency of about 15 HZ. The timing control part 350 generates a first clock signal CLK1 and a second clock signal CLK2 using the clock signal and outputs the first clock signal CLK1 to the data driving part 320 and the second clock signal CLK2 to the gate driving part 330.

The timing control part 350 outputs a dimming signal DIM2 that controls a luminance of the light source part 360. The dimming data storing part 340 in the timing control part 350 stores the display panel surface average luminance change dimming data.

The display panel surface average luminance change dimming data is a data generated by reversing a display panel surface average luminance change data and converting the reversed data to a digital data by a pulse width modulation. Thus, the display panel surface average luminance change data is reversed and the reversed data is digitally modulated to generate the display panel surface average luminance change dimming data to that a waveform of the display panel surface average luminance data is opposite to a waveform of a light source luminance change indicating a luminance of the light source part 360. The display panel surface average luminance change dimming data may be stored in ROM (Read Only Memory), and the display panel surface average luminance change dimming data may be outputted as a dimming signal DIM2. Thus, the timing control part 350 may read the display panel surface average luminance change dimming data in the dimming data storing part 340 to output the dimming signal DIM2 to the light source driving part 400 light source luminance change LSL2

According to an embodiment, the data driving part 320 is substantially the same as the data driving part 120 of FIG. 1 except that signals generated from the data driving part 320 may be different from signals generated from the data driving part 120.

The gate driving part 330 generates a gate signal using the vertical start signal STV2 and the second clock signal SLK2 provided from the timing control part 350 and outputs the gate signal to the gate line GL.

The dimming data storing part 340 may store the display panel surface average luminance change dimming data generated from a light source luminance change indicating the luminance of the light source part 360 of which the waveform is opposite to the waveform of the display panel surface average luminance change data indicating the luminance of the display panel 310, may output the display panel surface average luminance change dimming data to the timing control part 350, and the timing control part 350 may output the display panel surface average luminance change dimming data as the dimming signal DIM2.

The light source part 360 is driven in response to the light source driving signal LDS2 outputted from the light source driving part 400 and provides light to the display panel 310. light source luminance change LSL2

The light source driving part 400 receives the dimming signal DIM2 outputted from the timing control part 350, and outputs the light source driving signal LDS2 to the light source part 360 based on the dimming signal DIM2.

Figure 6:
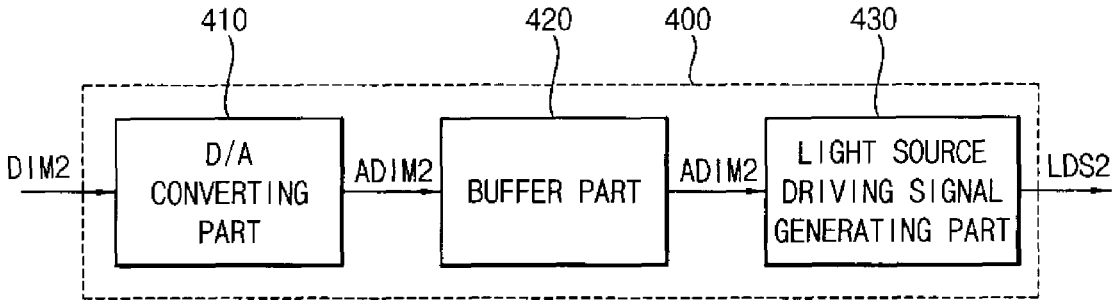
FIG. 6 is a block diagram illustrating the light source driving part of FIG. 5.

FIG. 6 is a block diagram illustrating the light source driving part 400 of FIG. 5.

Referring to FIGS. 5 and 6, the light source driving part 400 includes a digital/analog converting part 410, a buffer part 420 and a light source driving signal generating part 430.

The digital/analog converting part 410 receives the dimming signal DIM2 from the timing control part 350. According to an embodiment, the dimming signal DIM2 may be a digital signal. For example, according to an embodiment, the dimming signal DIM2 may be a pulse width modulation (PWM) signal. The digital/analog converting part 410 converts the dimming signal DIM2 to an analog dimming signal ADIM2 and outputs the converted analog dimming signal ADIM2. According to an embodiment, the analog dimming signal ADIM2 may be a voltage signal. The buffer part 420 buffers the analog dimming signal ADIM2.

The light source driving signal generating part 430 receives the analog dimming signal ADIM2, and converts the analog dimming signal ADIM2 to the light source driving signal LDS2 and outputs the light source driving signal LDS2 to the light source part 360. According to an embodiment, the light source driving signal LDS2 may be a current signal.

Figure 7:
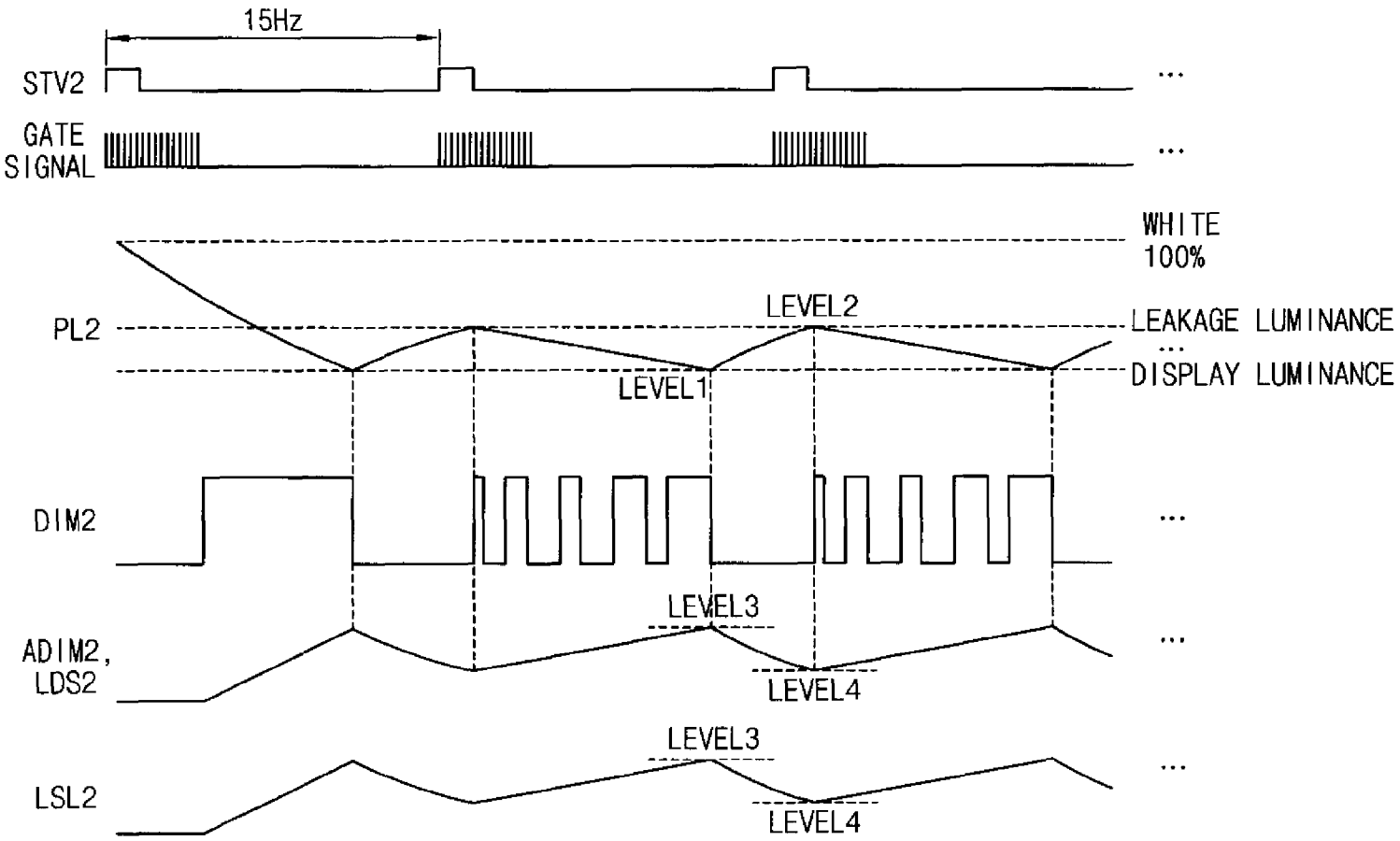
FIG. 7 is a waveform diagram illustrating a vertical start signal, a display panel surface average luminance change data, a dimming signal, an analog dimming signal, a light source driving signal and a light source luminance change as shown in FIGS. 5 and 6.

FIG. 7 is a waveform diagram illustrating the vertical start signal STV2, the display panel surface average luminance change data PL2, the dimming signal DIM2, the analog dimming signal ADIM2, the light source driving signal LDS2 and the light source luminance change LSL2 of FIGS. 5 and 6.

Referring to FIGS. 5 to 7, the vertical start signal STV2 has a frequency of about 15 Hz, and a frame of the image data DATA has a frequency of about 60 Hz. Thus, a gate signal is applied to a gate line GL during a quarter of the period between two vertical starts signals STV2 adjacent to each other.

According to an embodiment, the display panel 310 is in a normally white mode. The display panel surface average luminance change data PL2 may have a first level LEVEL1 when a first voltage is applied to a pixel electrode of the display panel 310 and the display panel surface average luminance change data PL2 may have a second level LEVEL2 higher than the first level LEVEL1 when a second voltage lower than the first voltage is applied to the pixel electrode of the display panel 310. For example, according to an embodiment, the first voltage may be a pixel voltage applied to the pixel electrode without a voltage leakage, and the pixel voltage is reduced by a leakage voltage, thus resulting in the second voltage.

A waveform of the light source luminance change LSL2 indicating the luminance of the light source part 360 is opposite to a waveform of the display panel surface average luminance change data PL2. For example, the light source luminance change LSL2 is decreased as the display panel surface average luminance change data PL2 is increased, and the light source luminance change LSL2 is increased as the display panel surface average luminance change data PL2 is decreased. The light source luminance change LSL2 has a third level LEVEL3 when the display panel surface average luminance change data PL2 has the first level LEVEL1, and the light source luminance change LSL2 has a fourth level LEVEL4 lower than the third level LEVEL3 when the display panel surface average luminance change data PL2 has the second level LEVEL2 higher than the first level LEVEL1.

The light source driving signal LDS2 and the analog dimming signal ADIM2 are signals for driving the light source part 360, and thus each of the waveforms of the light source driving signal LDS2 and the analog dimming signal ADIM2 is substantially the same as the waveform of the light source luminance change LSL2. Thus, each of the light source driving signal LDS2 and the analog dimming signal ADIM2 has the third level LEVEL3 when the display panel surface average luminance change data PL2 has the first level LEVEL1, and each of the light source driving signal LDS2 and the analog dimming signal ADIM2 has the fourth level LEVEL4 lower than the third level LEVEL3 when the display panel surface average luminance change data PL2 has the second level LEVEL2 higher than the first level LEVEL1.

Each of the waveforms of the light source driving signal LDS2, the analog diming signal ADIM2 and the light source luminance change LSL2 is opposite to the waveform of the display panel surface average luminance change data PL2, and thus each of the waveforms of the light source driving signal LDS2, the analog diming signal ADIM2 and the light source luminance change LSL2 has a portion symmetric or substantially symmetric with the waveform of the display panel surface average luminance change data PL2. Thus, a difference between the first level LEVEL1 and the second level LEVEL2 of the display panel surface average luminance change data PL2 is substantially the same as a difference between the third level LEVEL3 and the fourth level LEVEL4 of the light source driving signal LDS2, the analog diming signal ADIM2 and the light source luminance change LSL2.

A low level period of the dimming signal DIM2 is increased and a high level period of the dimming signal DIM2 is decreased so that the analog dimming signal ADIM2 is decreased as the display panel surface average luminance change data PL2 is increased, and the low level period of the dimming signal DIM2 is decreased and the high level period of the dimming signal DIM2 is increased so that the analog dimming signal ADIM2 is increased as the display panel surface average luminance change data PL2 is decreased.

Figure 8:
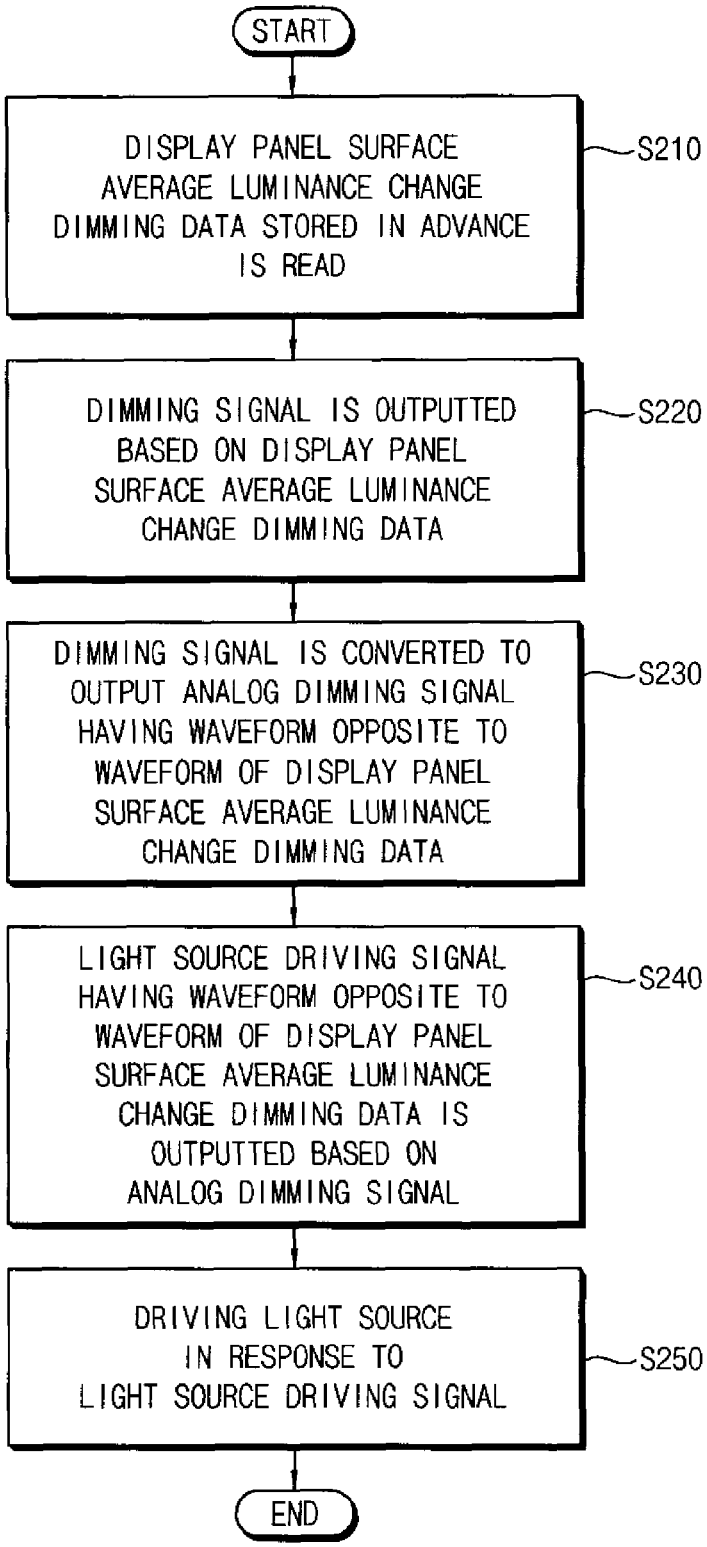
FIG. 8 is a flow chart illustrating a method of driving a light source by the light source apparatus of FIG. 5.

FIG. 8 is a flowchart illustrating a method of driving a light source by the light source apparatus 301 of FIG. 5.

Referring to FIGS. 5 to 8, the display panel surface average luminance change dimming data is stored in the dimming data storing part 340, and the dimming data is read from the dimming data storing part 340 using the timing control part 350 (step S210). The display panel 310 displays the image data DATA in response to the vertical start signal STV2. According to an embodiment, the vertical start signal STV2 has a frequency of about 15 Hz. According to an embodiment, the display panel 310 is in a normally white mode. Thus, the display panel surface average luminance change data PL2 has the first level LEVEL1 when the first voltage is applied to the pixel electrode of the display panel 310, and the display panel surface average luminance change data PL2 has the second level LEVEL2 higher than the first level LEVEL1 when the second voltage lower than the first voltage is applied to the pixel electrode of the display panel 310.

The dimming signal DIM2 modulated based on the display panel surface average luminance change data PL2 by the pulse width modulation is outputted (step S220). The timing control part 350 outputs the dimming signal DIM2 based on the display panel surface average luminance change data PL2 so that the waveform of the light source luminance change LSL2 indicating the luminance of the light source part 360 is opposite to the waveform of the display panel surface average luminance change data PL2. According to an embodiment, the dimming signal DIM2 may be a pulse width modulation (PWM) signal. The low level period of the dimming signal DIM2 is increased and the high level period of the dimming signal DIM2 is decreased so that the analog dimming signal ADIM2 is decreased as the display panel surface average luminance change data PL2 is increased, and the low level period of the dimming signal DIM2 is decreased and the high level period of the dimming signal DIM2 is increased so that the analog dimming signal ADIM2 is increased as the display panel surface average luminance change data PL2 is decreased.

The diming signal DIM2 is converted to the analog dimming signal ADIM2, and the converted analog dimming signal ADIM2 is output (step S230). The analog dimming signal ADIM2 is decreased as the display panel surface average luminance change data PL2 is increased and the analog dimming signal ADIM2 is increased as the display panel surface average luminance change data PL2 is decreased according to the dimming signal DIM2. Thus, the waveform of the analog dimming signal ADIM2 is opposite to the waveform of the display panel surface average luminance change data PL2. According to an embodiment, the analog dimming signal ADIM2 may be a voltage signal.

The light source driving signal LDS2 is outputted based on the analog dimming signal ADIM2 (step S240). The waveform of the light source driving signal LDS2 is substantially the same as the waveform of the analog dimming signal ADIM2. Thus, the waveform of the light source driving signal LDS2 is opposite to the waveform of the display panel surface average luminance change data PL2. According to an embodiment, the light source driving signal LDS2 may be a current signal.

The light source part 360 is driven in response to the light source driving signal LDS2 (step S250). The light source part 360 generates light and provides the light to the display panel 310. The waveform of the light source luminance change LSL2 indicating the luminance of the light source part 360 is substantially the same as the waveform of the light source driving signal LDS2. Thus, the waveform of the light source luminance change LSL2 indicating the luminance of the light source part 360 is opposite to the waveform of the display panel surface average luminance change data PL2.

According to the present exemplary embodiment, the light source part 360 is driven so that the waveform of the light source luminance change LSL2 indicating the luminance of the light source part 360 is opposite to the waveform of the display panel surface average luminance change data PL2 indicating the luminance of the display panel 310. Therefore, a luminance difference of the display panel 310 is decreased, although the display panel 310 is driven by the vertical start signal STV2 having a low frequency, such as about 15 Hz, and thus a flicker is prevented from being generated. Thus, the display quality of the display apparatus 300 may be enhanced.

Figure 9:
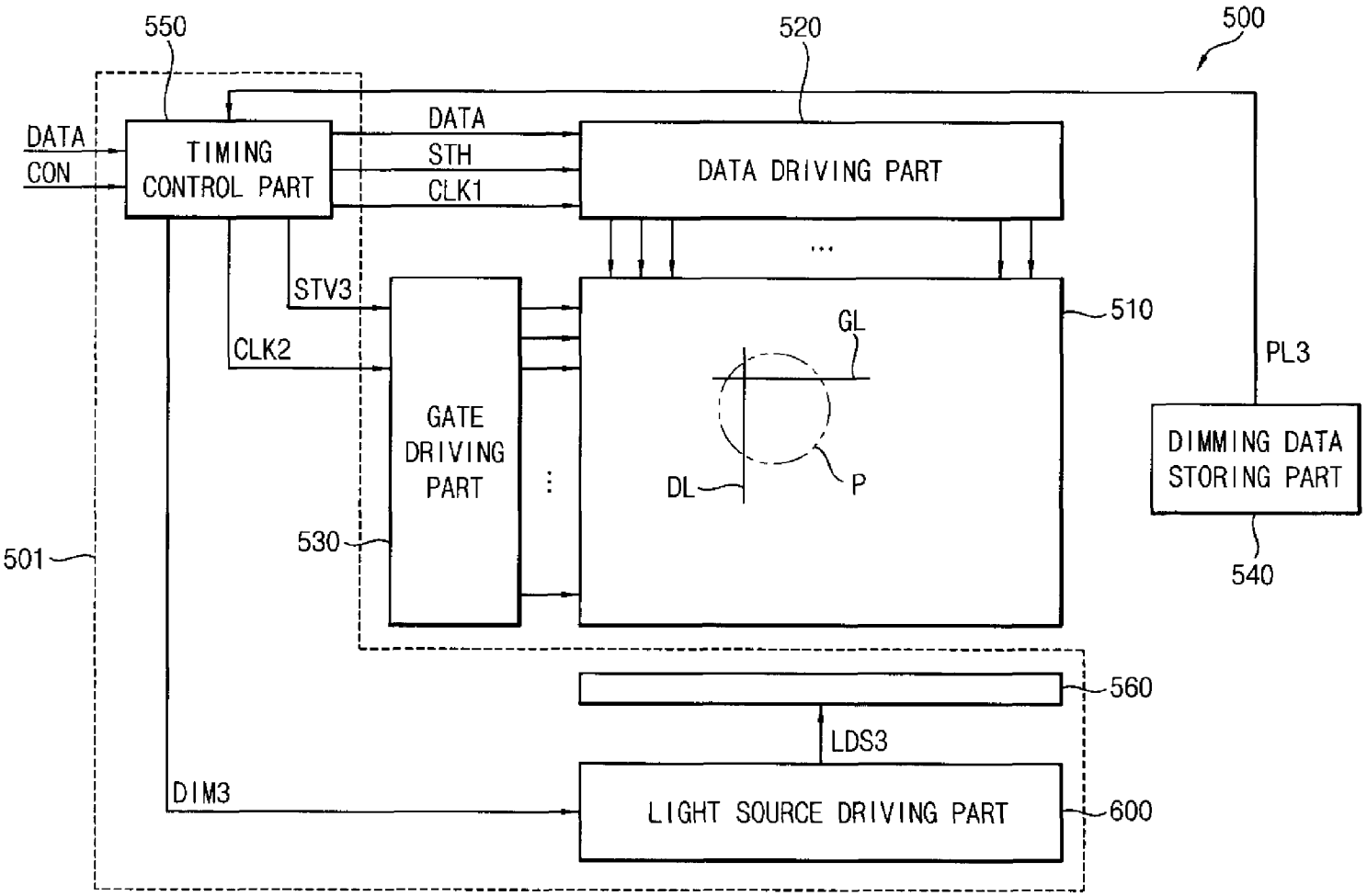
FIG. 9 is a block diagram illustrating a display apparatus according to an exemplary embodiment of the present invention.

FIG. 9 is a block diagram illustrating a display apparatus according to an exemplary embodiment of the present invention.

Referring to FIG. 9, the display apparatus 500 according to an exemplary embodiment includes a display panel 510, a data driving part 520, a gate driving part 530 and a light source apparatus 501. The light source apparatus 501 includes a dimming data storing part 540, a timing control part 550, a light source part 560 and a light source driving part 600.

According to an embodiment, the display panel 510 is substantially the same as the display panel 110 of FIG. 1 except that signals generated from the display panel 510 may be different from signals generated from the display panel 110.

The timing control part 550 receives image data DATA and a control signal CON from an outside source. The control signal CON may include a horizontal synchronous signal Hsync, a vertical synchronous signal Vsync and a clock signal.

The timing control part 550 generates a horizontal start signal STH using the horizontal synchronous signal Hsync and outputs the horizontal start signal STH to the data driving part 520. The timing control part 550 generates a vertical start signal STV3 using the vertical synchronous signal Vsync and outputs the vertical start signal STV3 to the gate driving part 530. According to an embodiment, the vertical start signal STV3 may have a frequency of about 15 HZ. The timing control part 550 generates a first clock signal CLK1 and a second clock signal CLK2 using the clock signal and outputs the first clock signal CLK1 to the data driving part 520 and the second clock signal CLK2 to the gate driving part 530.

The timing control part 550 outputs a dimming signal DIM3 that controls a luminance of the light source part 560. The timing control part 550 receives a dimming data DD from the dimming data storing part 540 display panel luminance change data PL3, and outputs the dimming signal DIM3 to the light source driving part 600 based on the dimming data DD so that a waveform of a light source luminance change LSL3 indicating the luminance of the light source part 560 is opposite to a waveform of a display panel luminance change data indicating a luminance of the display panel 510.

According to an embodiment, the data driving part 520 is substantially the same as the data driving part 120 of FIG. 1 except that signals generated from the data driving part 520 may be different from signals generated from the data driving part 120, and the gate driving part 530 is substantially the same as the gate driving part 330 of FIG. 5 except that signals generated from the gate driving part 530 may be different from signals generated from the gate driving part 330.

The dimming data storing part 540 measures a luminance change of the display panel 510, and stores the dimming data DD generated by modulating a data opposite to the display panel luminance change data indicating the luminance change of the display panel 510 by a pulse width modulation. Thus, the dimming data storing part 540 outputs the dimming data DD opposite to the pulse width modulated data from the display panel luminance change data.

The light source part 560 is driven in response to the light source driving signal LDS3 outputted from the light source driving part 600 and provides light to the display panel 510. The light source part 560 may generate the light source luminance change LSL3 that indicates the luminance of the light source part 560. In this process, eyes of a viewer may perform as a filter, and thus a luminance change data opposite to the display panel luminance change data may be provided to the light source part 560.

The light source driving part 600 receives the dimming signal DIM3 outputted from the timing control part 550, and outputs the light source driving signal LDS3 to the light source part 560 based on the dimming signal DIM3. The light source driving part 600 does not include the digital/analog converting part 410 in comparison with the light source driving part 400 of FIG. 5. Thus, the light source driving signal LDS3 outputted from the light source driving part 600 may be a digital signal.

Figure 10:
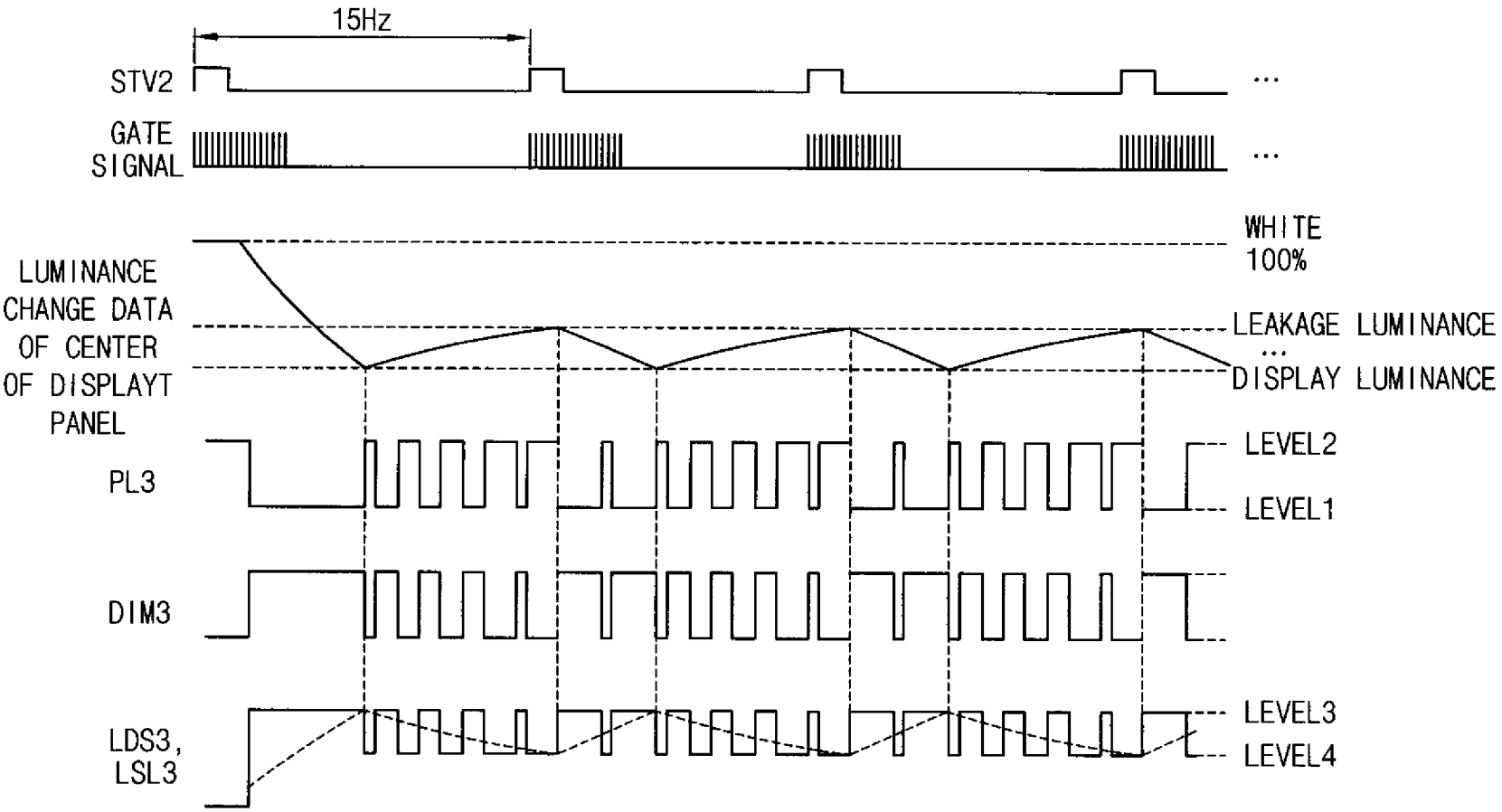
FIG. 10 is a waveform diagram illustrating a vertical start signal, a display panel luminance change data, a dimming signal, a light source driving signal and a light source luminance change as shown in FIG. 9.

FIG. 10 is a waveform diagram illustrating the vertical start signal STV3, the display panel luminance change data PL3, the dimming signal DIM3, the light source driving signal LDS3 and the light source luminance change LSL3 of FIG. 9.

Referring to FIGS. 9 and 10, the vertical start signal STV3 has a frequency of about 15 Hz, and a frame of the image data DATA has a frequency of about 60 Hz. Thus, a gate signal is applied to a gate line GL during a quarter of the period between two vertical starts signals STV3 adjacent to each other.

According to an embodiment, the display panel 510 is in a normally white mode. The display panel luminance change data PL3 may have a first level LEVEL1 when a first voltage is applied to a pixel electrode of the display panel 510 and the display panel luminance change data PL3 may have a second level LEVEL2 higher than the first level LEVEL1 when a second voltage lower than the first voltage is applied to the pixel electrode of the display panel 510. For example, according to an embodiment, the first voltage may be a pixel voltage applied to the pixel electrode without a voltage leakage, and the pixel voltage is reduced by a leakage voltage, thus resulting in the second voltage.

A low level period of the dimming signal DIM3 is increased and a high level period of the dimming signal DIM3 is decreased so that the light source luminance change LSL3 is decreased as the display panel luminance change data PL3 is increased, and the low level period of the dimming signal DIM3 is decreased and the high level period of the dimming signal DIM3 is increased so that the light source luminance change LSL3 is increased as the display panel surface average luminance change data PL2 is decreased.

The light source driving signal LDS3 is the digital signal, and the waveform of the light source driving signal LDS3 is substantially the same as the waveform of the dimming signal DIM3.

The light source part 560 is driven in response to the light source driving signal LDS3. The light source part 560 generates light having a first luminance when the light source driving signal LDS3 has a high level, and the light source part 560 generates light having a second luminance lower than the first luminance when the light source driving signal LDS3 has a low level.

A waveform of the light source luminance change LSL3 indicating the luminance of the light source part 560 is opposite to the waveform of the display panel luminance change data PL3. The light source luminance change LSL3 is decreased as the display panel luminance change data PL3 is increased, and the light source luminance change LSL3 is increased as the display panel luminance change data PL3 is decreased. The light source luminance change LSL3 has a third level LEVEL3 when the display panel luminance change data PL3 has the first level LEVEL1, and the light source luminance change LSL3 has a fourth level LEVEL4 lower than the third level LEVEL3 when the display panel luminance change data PL3 has the second level LEVEL2 higher than the first level LEVEL1.

Figure 11:
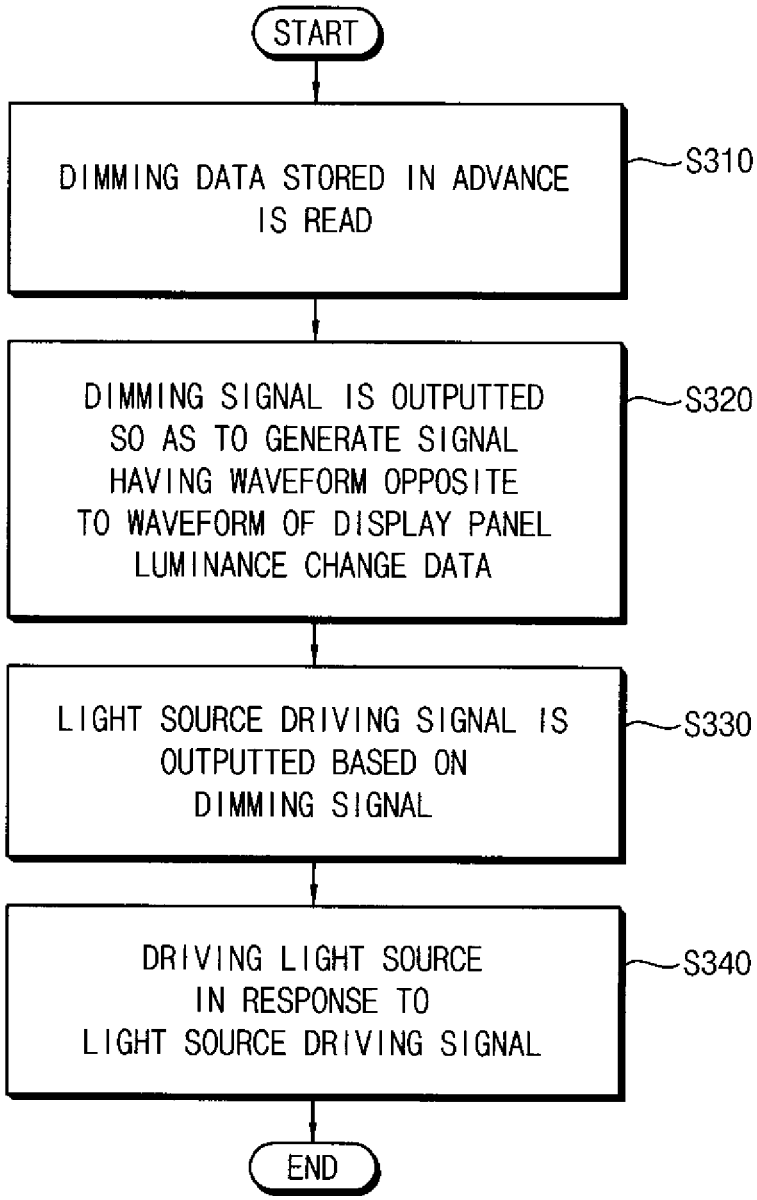
FIG. 11 is a flow chart illustrating a method of driving a light source by the light source apparatus of FIG. 9.

FIG. 11 is a flowchart illustrating a method of driving a light source by the light source apparatus 501 of FIG. 9.

Referring to FIGS. 9 to 11, the dimming data DD is stored in the dimming data storing part 540 and the dimming data DD is read from the dimming data storing part 540 (step S310). The dimming data DD is opposite to the data modulated from the display panel luminance change data PL3 indicating the display panel 510 by the pulse width modulation. The display panel 510 displays the image data DATA in response to the vertical start signal STV3. According to an embodiment, the vertical start signal STV3 has a frequency of about 15 Hz. According to an embodiment, the display panel 310 is in a normally white mode. Thus, a low level period of the dimming data DD is increased and a high level period of the dimming data DD is decreased so that the luminance of the light source part 560 is decreased as the luminance of the display panel 510 is increased. In addition, the low level period of the dimming data DD is decreased and the high level period of the dimming data DD is increased so that the luminance of the light source part 560 is increased as the luminance of the display panel 510 is decreased.

The dimming signal DIM3 is outputted based on the dimming data DD (step S320). The timing control part 550 outputs the dimming signal DIM3 based on the dimming data DD so that the waveform of the light source luminance change LSL3 indicating the luminance of the light source part 560 is opposite to the waveform of the display panel luminance change data PL3. According to an embodiment, the dimming signal DIM3 may be a pulse width modulation (PWM) signal. The low level period of the dimming signal DIM3 is increased and the high level period of the dimming signal DIM3 is decreased so that the light source luminance change LSL3 is decreased as the display panel luminance change data PL3 is increased, and the low level period of the dimming signal DIM3 is decreased and the high level period of the dimming signal DIM3 is increased so that the light source luminance change LSL3 is increased as the display panel luminance change data PL3 is decreased.

The light source driving signal LDS3 is outputted based on the dimming signal DIM3 (step S330). According to an embodiment, the light source driving signal LDS3 is a digital signal, and the waveform of the light source driving signal LDS3 is substantially the same as the waveform of the dimming signal DIM3.

The light source part 560 is driven in response to the light source driving signal LDS3 (step S340). The light source part 560 generates light and provides the light to the display panel 510. The light source part 560 generates the light having the first luminance when the light source driving signal LDS3 is at a high level, and the light source part 560 generates the light having the second luminance lower than the first luminance when the light source driving signal LDS3 is at a low level. Thus, the waveform of the light source luminance change LSL3 indicating the luminance of the light source part 560 is opposite to the waveform of the display panel luminance change data PL3.

Figure 12:
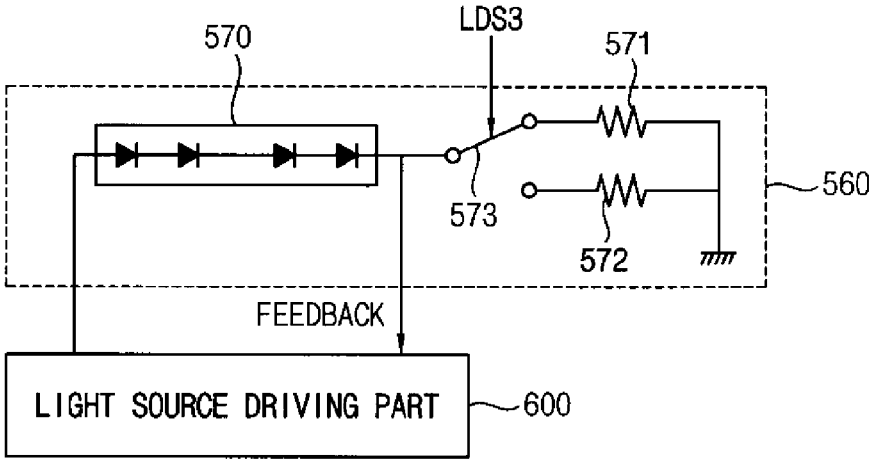
FIG. 12 is a block diagram illustrating a light source part and a light source driving part as shown in FIG. 9.

FIG. 12 is a block diagram illustrating the light source part 560 and the light source driving part 600 of FIG. 9.

Referring to FIGS. 9 to 12, the light source part 560 includes a light source 570, a first resistor 571, a second resistor 572 and a switch 573.

The switch 573 is disposed among the light source 570, the first resistor 571 and the second resistor 572. The switch 573 is electrically connected to the first resistor 571 or electrically connected to the second resistor 572 in response to the light source driving signal LDS3 which is a current signal. Thus, the switch 573 selectively connects the light source 570 with the first resistor 571, or selectively connects the light source 570 with the second resistor 572.

A resistance of the first resistor 571 and a resistance of the second resistor 572 are different from each other. For example, the resistance of the first resistor 571 may be greater than the resistance of the second resistor 572. Alternatively, the resistance of the first resistor 571 may be less than the resistance of the second resistor 572.

A luminance of the light source 570 may be the low level when the light source 570 is connected to the first resistance 571, and the luminance of the light source 570 may be the high level when the light source is connected to the second resistance 572. Alternatively, the luminance of the light source 570 may be the high level when the light source 570 is connected to the first resistance 571, and the luminance of the light source 570 may be the low level when the light source is connected to the second resistance 572. Thus, the luminance of the light source part 560 may be controlled using the current signal.

The light source 570 may give a feedback to the light source driving part 600. Thus, a signal from the light source 570 may be outputted to the light source driving part 600.

In an exemplary embodiment, the vertical start signal STV3 has a frequency of about 15 Hz, but it is not limited thereto. For example, according to an embodiment, the vertical start signal STV3 may have a frequency of about 30 Hz.

According to an exemplary embodiment, the light source part 560 is driven using the digital signal so that the waveform of the light source luminance change LSL3 indicating the luminance of the light source part 560 is opposite to the waveform of the display panel luminance change data PL3 indicating the luminance of the display panel 510. Therefore, a luminance difference of the display panel 510 is decreased, although the display panel 510 is driven by the vertical start signal STV3 having a low frequency, such as about 15 Hz or about 30 Hz, and thus a flicker may be prevented from being generated. Thus, the display quality of the display apparatus 500 may be enhanced.

Figure 13:
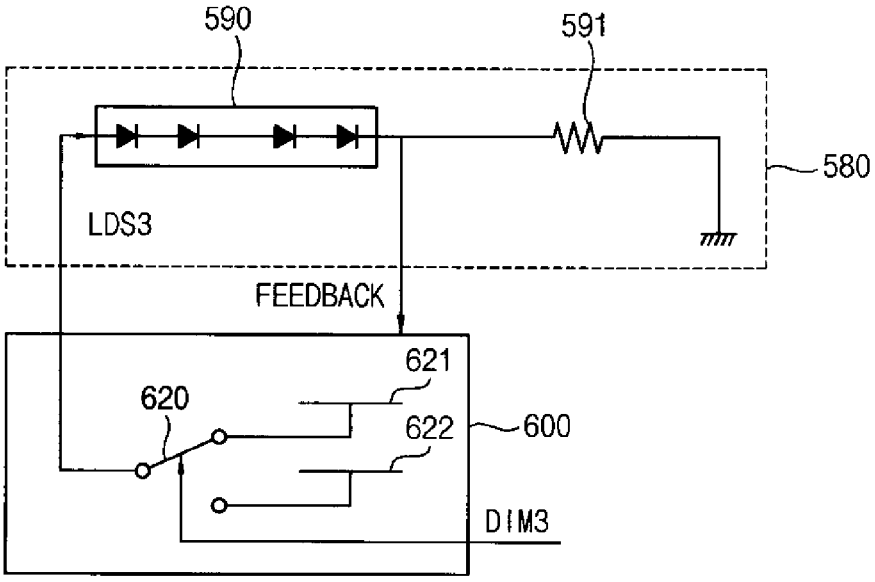
FIG. 13 is a block diagram illustrating a light source part and a light source driving part according to still another example embodiment of the present invention.

FIG. 13 is a block diagram illustrating a light source part and a light source driving part according to still another example embodiment of the present invention.

The light source part 580 and the light source driving part 610 may be in the display apparatus 500 of FIG. 9 according the previous example embodiment. Thus, the same reference numerals will be used to refer to same or like parts as those described in the previous example embodiment and any further repetitive explanation concerning the above elements will be omitted.

Referring to FIGS. 9 and 13, the light source part 580 includes a light source 590 and a resistor 591.

The light source driving part 610 includes a switch 620. The switch 620 is disposed among the light source 590, a first voltage terminal 621 and a second voltage terminal 622. A first voltage and a second voltage different from each other are respectively applied to the first voltage terminal 621 and the second voltage terminal 622. For example, the first voltage may be greater than the second voltage. Alternatively, the first voltage may be less than the second voltage.

The switch 620 is electrically connected to the first voltage terminal 621 or electrically connected to the second voltage terminal 622 in response to the dimming signal DIM3 which is a voltage signal. Thus, the switch 620 selectively connects the light source 590 with the first voltage terminal 621 or selectively connects the light source 590 with the second voltage terminal 622.

A luminance of the light source 590 may be the low level when the light source 590 is connected to the first voltage terminal 621, and the luminance of the light source 590 may be the high level when the light source 590 is connected to the second voltage terminal 622. Alternatively, the luminance of the light source 590 may be the high level when the light source 590 is connected to the first voltage terminal 621, and the luminance of the light source 590 may be the low level when the light source 590 is connected to the second voltage terminal 622. Thus, a luminance of the light source part 580 may be controlled using the voltage signal.

The light source 590 may give a feedback to the light source driving part 610. Thus, a signal from the light source 590 may be outputted to the light source driving part 610.

According to the present exemplary embodiment, the luminance of the light source part 580 may be controlled using the voltage signal.

Figure 14:
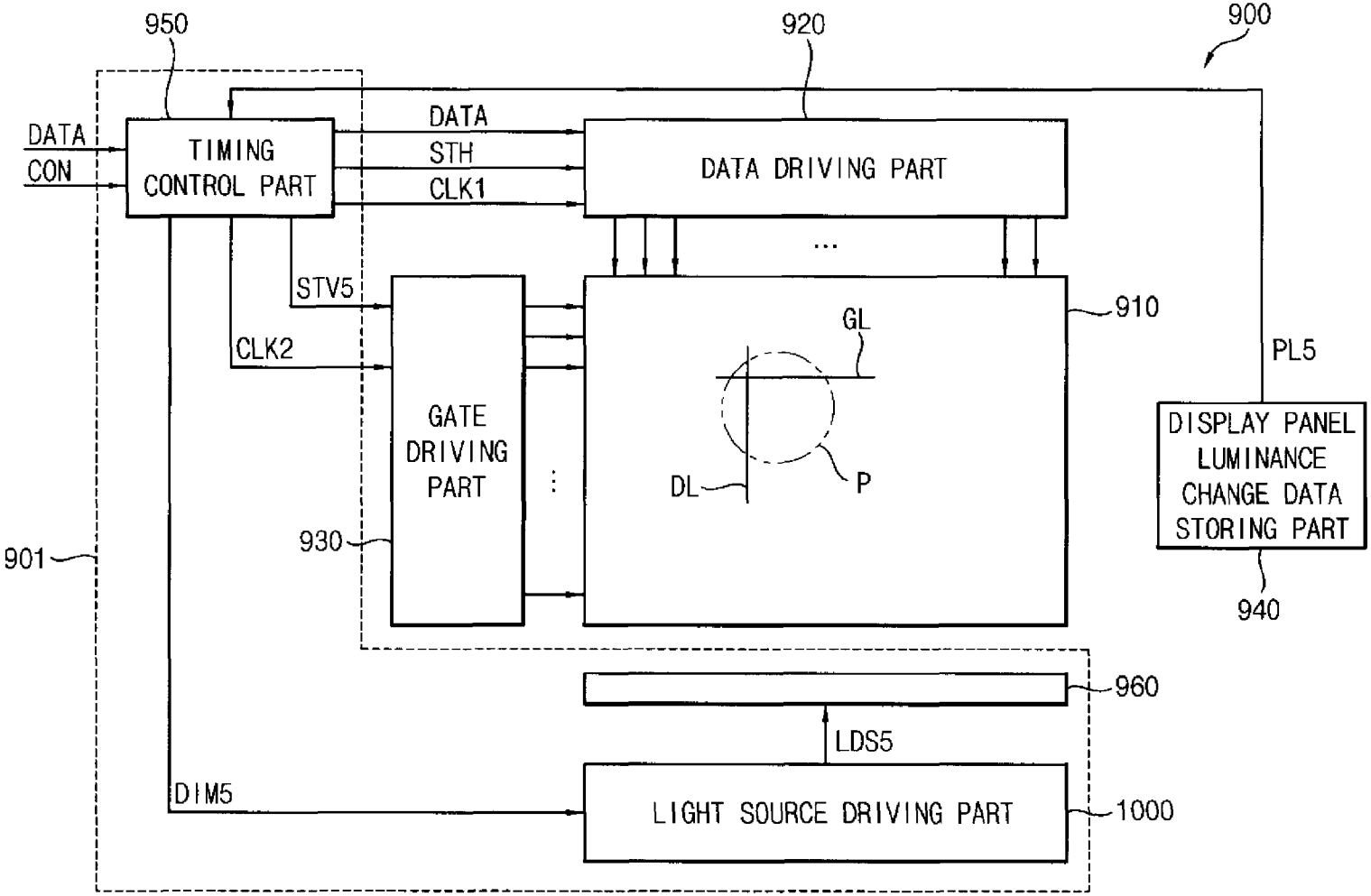
FIG. 14 is a block diagram illustrating a display apparatus according to an exemplary embodiment of the present invention.

FIG. 14 is a block diagram illustrating a display apparatus according to an exemplary embodiment of the present invention.

Referring to FIG. 14, the display apparatus 900 according to an exemplary embodiment includes a display panel 910, a data driving part 920, a gate driving part 930, a display panel luminance change data storing part 940 and a light source apparatus 901. The light source apparatus 901 includes a timing control part 950, a light source part 960 and a light source driving part 1000.

The display panel 910 receives image data DATA to display an image. The display panel 910 may include a pixel electrode, a common electrode facing the pixel electrode, and a liquid crystal layer interposed between the pixel electrode and the common electrode. According to an embodiment, the display panel 910 may be in a normally black mode. Thus, the display panel 910 may be in a full black state when a pixel voltage is not applied to the pixel electrode.

The timing control part 950 receives the image data DATA and a control signal CON from an outside source. The control signal CON may include a horizontal synchronous signal Hsync, a vertical synchronous signal Vsync and a clock signal.

The timing control part 950 generates a horizontal start signal STH using the horizontal synchronous signal Hsync and outputs the horizontal start signal STH to the data driving part 920. The timing control part 950 generates a vertical start signal STV5 using the vertical synchronous signal Vsync and outputs the vertical start signal STV5 to the gate driving part 930. According to an embodiment, the vertical start signal STV5 may have a frequency of about 30 HZ. The timing control part 950 generates a first clock signal CLK1 and a second clock signal CLK2 using the clock signal and outputs the first clock signal CLK1 to the data driving part 920 and the second clock signal CLK2 to the gate driving part 930.

The timing control part 950 outputs a dimming signal DIM5 that controls a luminance of the light source part 960. The timing control part 950 receives a display panel luminance change data PL5 from the panel luminance measuring part 940, and outputs the dimming signal DIM5 to the light source driving part 1000 based on the display panel luminance change data PL5 so that a waveform of a light source luminance change LSL5 indicating the luminance of the light source part 960 is opposite to a waveform of the display panel luminance change data PL5. Thus, the timing control part 950 controls the light source driving part 1000 so that the waveform of the display panel luminance change data PL5 is opposite to a waveform of a light source luminance change indicating the luminance of the light source part 960.

According to an embodiment, the data driving part 920 is substantially the same as the data driving part 120 of FIG. 1 except that signals generated from the data driving part 920 may be different from signals generated from the data driving part 120, and the gate driving part 930 is substantially the same as the gate driving part 130 of FIG. 1 except that signals generated from the gate driving part 930 may be different from signals generated from the gate driving part 130.

The display panel luminance change data storing part 940 measures a luminance of the display panel 910, stores the display panel luminance change data PL5 indicating a luminance change of the display panel 910 with respect to time and indicating the luminance of the display panel 910, and outputs the display panel luminance change data PL5 that indicates the luminance of the display panel 910 to the timing control part 950.

The light source part 960 is driven in response to the light source driving signal LDS5 outputted from the light source driving part 1000 and provides light to the display panel 910. The light source luminance change of which the waveform is opposite to the waveform of the display panel luminance change data PL5 indicates a luminance change of the light source part 960. change LSL5

The light source driving part 1000 receives the dimming signal DIM5 outputted from the timing control part 950, and outputs the light source driving signal LDS5 to the light source part 960 based on the dimming signal DIM5.

Figure 15:
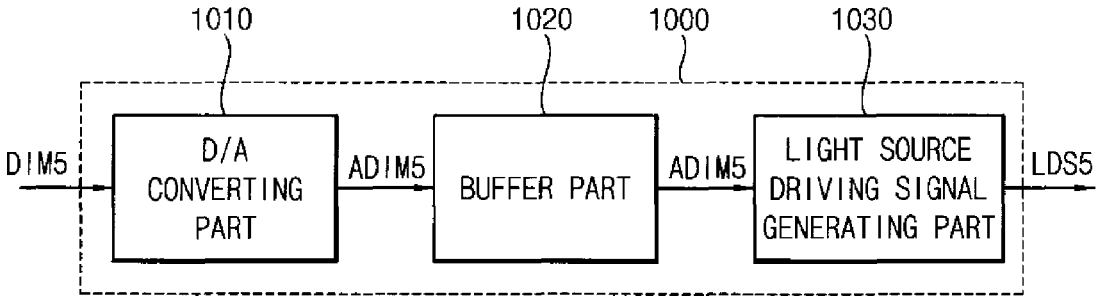
FIG. 15 is a block diagram illustrating the light source driving part of FIG. 14.

FIG. 15 is a block diagram illustrating the light source driving part 1000 of FIG. 14.

Referring to FIGS. 14 and 15, the light source driving part 1000 includes a digital/analog converting part 1010, a buffer part 1020 and a light source driving signal generating part 1030.

The digital/analog converting part 1010 receives the dimming signal DIM5 from the timing control part 950. According to an embodiment, the dimming signal DIM5 may be a digital signal. For example, according to an embodiment, the dimming signal DIM5 may be a pulse width modulation (PWM) signal. The digital/analog converting part 1010 converts the dimming signal DIM5 to an analog dimming signal ADIM5 and outputs the converted analog dimming signal ADIM2. According to an embodiment, the analog dimming signal ADIM5 may be a voltage signal. The buffer part 1020 buffers the analog dimming signal ADIM5.

The light source driving signal generating part 1030 receives the analog dimming signal ADIM5, and converts the analog dimming signal ADIM5 to the light source driving signal LDS5 and outputs the light source driving signal LDS5 to the light source part 960. According to an embodiment, the light source driving signal LDS5 may be a current signal.

Figure 16:
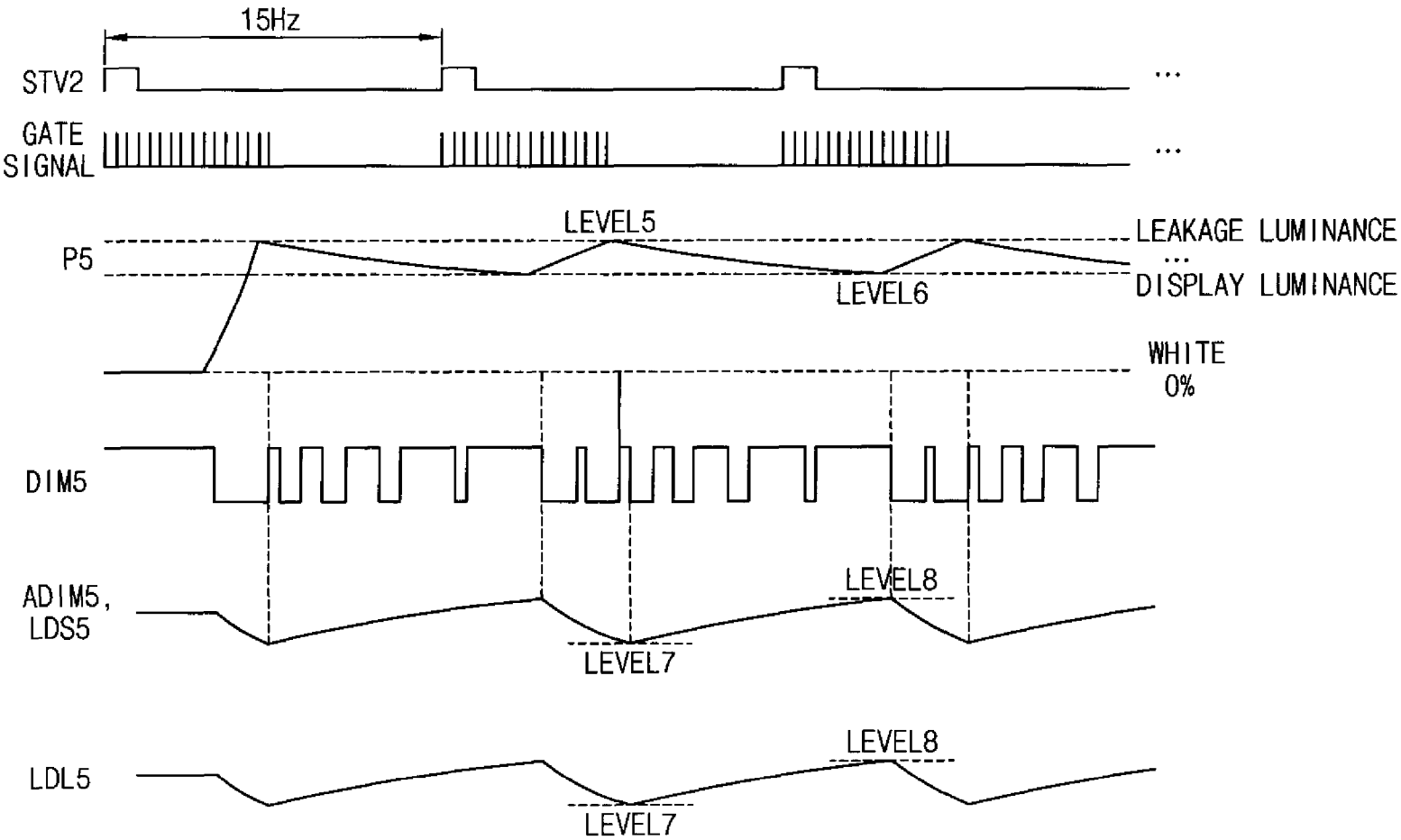
FIG. 16 is a waveform diagram illustrating a vertical start signal, a display panel luminance change data, a dimming signal, an analog dimming signal, a light source driving signal and a light source luminance change as shown in FIGS. 14 and 15.

FIG. 16 is a waveform diagram illustrating the vertical start signal STV5, the display panel luminance change data PL5, the dimming signal DIM5, the analog dimming signal ADIM5, the light source driving signal LDS5 and the light source luminance change LSL5 of FIGS. 14 and 15.

Referring to FIGS. 14 to 16, the vertical start signal STV5 has a frequency of about 30 Hz, and a frame of the image data DATA has a frequency of about 60 Hz. Thus, a gate signal is applied to a gate line GL during a half of the period between two vertical starts signals STV5 adjacent to each other.

According to an embodiment, the display panel 110 is in a normally black mode. The display panel luminance change data PL5 may have a fifth level LEVEL5 when a first voltage is applied to the pixel electrode of the display panel 910 and the display panel luminance change data PL5 may have a sixth level LEVEL6 lower than the fifth level LEVEL5 when a second voltage lower than the first voltage is applied to the pixel electrode of the display panel 910. For example, according to an embodiment, the first voltage may be a pixel voltage applied to the pixel electrode without a voltage leakage, and the pixel voltage is reduced by a leakage voltage, thus resulting in the second voltage.

A waveform of the light source luminance change LSL5 indicating the luminance of the light source part 960 is opposite to a waveform of the display panel luminance change data PL5. For example, the light source luminance change LSL5 is decreased as the display panel luminance change data PL5 is increased, and the light source luminance change LSL5 is increased as the display panel luminance change data PL5 is decreased. The light source luminance change LSL5 has a seventh level LEVEL7 when the display panel luminance change data PL5 has the fifth level LEVEL5, and the light source luminance change LSL5 has an eighth level LEVEL8 higher than the seventh level LEVEL7 when the display panel luminance change data PL5 has the sixth level LEVEL6 lower than the fifth level LEVEL5.

The light source driving signal LDS5 and the analog dimming signal ADIM5 are signals for driving the light source part 960, and thus each of the waveforms of the light source driving signal LDS5 and the analog dimming signal ADIM5 is substantially the same as the waveform of the light source luminance change LSL5. Thus, each of the light source driving signal LDS5 and the analog dimming signal ADIM5 has the seventh level LEVEL7 when the display panel luminance change data PL5 has the fifth level LEVEL5, and each of the light source driving signal LDS5 and the analog dimming signal ADIM5 has the eighth level LEVEL8 higher than the seventh level LEVEL7 when the display panel luminance change data PL5 has the sixth level LEVEL6 lower than the fifth level LEVEL5.

Each of the waveforms of the light source driving signal LDS5, the analog diming signal ADIM5 and the light source luminance change LSL5 is opposite to the waveform of the display panel luminance change data PL5, and thus each of the waveforms of the light source driving signal LDS5, the analog diming signal ADIM5 and the light source luminance change LSL5 has a portion symmetric or substantially symmetric with the waveform of the display panel luminance change data PL5. Thus, a difference between the fifth level LEVEL5 and the sixth level LEVEL6 of the display panel luminance change data PL5 is substantially the same as a difference between the seventh level LEVEL7 and the eighth level LEVEL8 of the light source driving signal LDS5, the analog diming signal ADIM5 and the light source luminance change LSL5.

A high level period of the dimming signal DIM5 is increased and a low level period of the dimming signal DIM5 is decreased so that the analog dimming signal ADIM5 is increased as the display panel luminance change data PL5 is decreased, and the high level period of the dimming signal DIM5 is decreased and the low level period of the dimming signal DIM5 is increased so that the analog dimming signal ADIM5 is decreased as the display panel luminance change data PL5 is increased.

Figure 17:
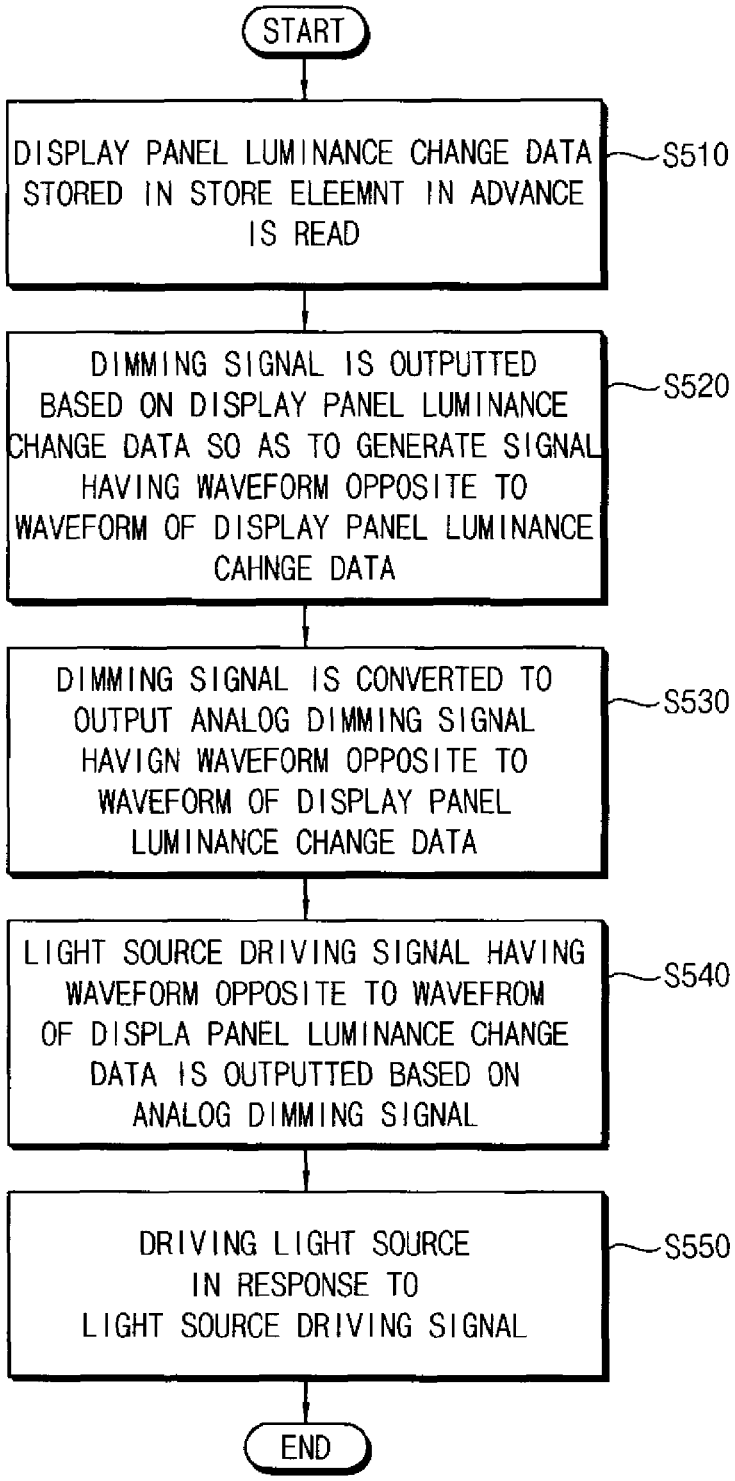
FIG. 17 is a flow chart illustrating a method of driving a light source by the light source apparatus of FIG. 14.

FIG. 17 is a flowchart illustrating a method of driving a light source by the light source apparatus 901 of FIG. 14.

Referring to FIGS. 14 to 17, the display panel luminance change data PL5 indicating the luminance of the display panel 910 is stored using the display panel luminance change data storing part 940, and read the display panel luminance change data PL5 from the display panel luminance change data storing part 940 (step S510). The display panel 910 displays the image data DATA in response to the vertical start signal STV5. According to an embodiment, the vertical start signal STV5 has a frequency of about 30 Hz. According to an embodiment, the display panel 910 is in a normally black mode. Thus, the display panel luminance change data PL5 has the fifth level LEVEL5 when the first voltage is applied to the pixel electrode of the display panel 910, and the display panel luminance change data PL5 has the sixth level LEVEL6 lower than the fifth level LEVEL5 when the second voltage lower than the first voltage is applied to the pixel electrode of the display panel 910.

The dimming signal DIM5 is outputted based on the display panel luminance change data PL5 (step S520). The timing control part 950 outputs the dimming signal DIM5 based on the display panel luminance change data PL5 so that the waveform of the light source luminance change LSL5 indicating the luminance of the light source part 960 is opposite to the waveform of the display panel luminance change data PL5. According to an embodiment, the dimming signal DIM5 may be a pulse width modulation (PWM) signal. The high level period of the dimming signal DIM5 is increased and the low level period of the dimming signal DIM5 is decreased so that the analog dimming signal ADIM5 is increased as the display panel luminance change data PL5 is decreased, and the high level period of the dimming signal DIM5 is decreased and the low level period of the dimming signal DIM5 is increased so that the analog dimming signal ADIM5 is decreased as the display panel luminance change data PL5 is increased.

The diming signal DIM5 is converted to the analog dimming signal ADIM5, and the converted analog dimming signal ADIM5 is output (step S530). The analog dimming signal ADIM5 is increased as the display panel luminance change data PL5 is decreased and the analog dimming signal ADIM5 is decreased as the display panel luminance change data PL5 is increased according to the dimming signal DIM5. Thus, the waveform of the analog dimming signal ADIM5 is opposite to the waveform of the display panel luminance change data PL5. According to an embodiment, the analog dimming signal ADIM5 may be a voltage signal.

The light source driving signal LDS5 is outputted based on the analog dimming signal ADIM5 (step S540). The waveform of the light source driving signal LDS5 is substantially the same as the waveform of the analog dimming signal ADIM5. Thus, the waveform of the light source driving signal LDS5 is opposite to the waveform of the display panel luminance change data PL5. According to an embodiment, the light source driving signal LDS5 may be a current signal.

The light source part 960 is driven in response to the light source driving signal LDS5 (step S550). The light source part 560 generates light and provides the light to the display panel 910. The waveform of the light source luminance change LSL5 indicating the luminance of the light source part 960 is substantially the same as the waveform of the light source driving signal LDS5. Thus, the waveform of the light source luminance change LSL5 indicating the luminance of the light source part 960 is opposite to the waveform of the display panel luminance change data PL5.

In an exemplary embodiment, the vertical start signal STV5 has a frequency of about 30 Hz, but it is not limited thereto. For example, according to an embodiment, the vertical start signal STV5 may have a frequency of about 15 Hz.

According to an exemplary embodiment, the light source part 960 is driven so that the waveform of the light source luminance change LSL5 indicating the luminance of the light source part 960 is opposite to the waveform of the display panel luminance change data PL5 indicating the luminance of the display panel 910 in the normally black mode. Therefore, a luminance difference of the display panel 910 is decreased, although the display panel 910 is driven by the vertical start signal STV5 having a low frequency, such as about 30 Hz or about 15 Hz in the normally black mode, and thus a flicker may be prevented from being generated. Thus, the display quality of the display apparatus 900 may be enhanced.

According to the method of driving the light source, the light source apparatus for performing the method and the display apparatus having the light source apparatus, a luminance difference of a display panel is decreased, although the display panel is driven by a vertical start signal having a low frequency, and thus a flicker may be prevented from being generated. Thus, the display quality of a display apparatus including the display panel may be enhanced.

The foregoing is illustrative of the embodiments of the present invention and is not to be construed as limiting thereof. Although a few exemplary embodiments of the present invention have been described, those skilled in the art will readily appreciate that many modifications are possible in the exemplary embodiments. Accordingly, all such modifications are intended to be included within the scope of the embodiments of the present invention as defined in the claims.

What is claimed is:

1. A method of driving a light source, the method comprising:

storing a display panel luminance change data indicating a luminance change of a display panel with respect to time;

outputting a light source driving signal, wherein the light source driving signal drives a light source part based on the display panel luminance change data so that a light source luminance outputted from the light source part is decreased when a display panel luminance is increased and the light source luminance is increased when the display panel luminance is decreased;

driving the light source part in response to the light source driving signal; and reading the display panel luminance change data or a dimming data from a storing element to output a dimming signal, wherein the dimming signal controls a luminance of the light source part, and the dimming data is converted from a data opposite to the display panel luminance change data by a pulse width modulation, wherein outputting the light source driving signal comprises converting the dimming signal to the light source driving signal, and wherein a first period during which the light source part generates light having a first luminance is increased as a level of the display panel luminance change data is decreased, and a second period during which the light source part generates light having a second luminance less than the first luminance is increased as the level of the display panel luminance change data is increased.

2. The method of claim 1, further comprising:

converting the dimming signal to an analog dimming signal, wherein outputting the light source driving signal includes converting the analog dimming signal to the light source driving signal.

3. The method of claim 1, wherein the display panel is configured to display an image in response to a vertical start signal having a first period, and the first period includes a scanning period during which a frame of image data displayed by the display panel is scanned and a standby period during which the frame of the image data is not scanned.

4. The method of claim 3, wherein at least one of the display panel luminance change data or a light source luminance change indicating the light source luminance has the first period.

5. The method of claim 1, wherein the luminance of the display panel is a luminance at a central portion of the display panel or an average luminance in the display panel.

6. The method of claim 1, wherein a waveform of the display panel luminance change data and a waveform of a light source luminance change indicating the light source luminance have portions substantially symmetric from each other.

7. A method of driving a light source, the method comprising:

storing a display panel luminance change data indicating a luminance change of a display panel with respect to time;

outputting a light source driving signal, wherein the light source driving signal drives a light source part based on the display panel luminance change data so that a light source luminance outputted from the light source part is decreased when a display panel luminance is increased and the light source luminance is increased when the display panel luminance is decreased; and driving the light source part in response to the light source driving signal, wherein the display panel is in a normally white mode, wherein the display panel luminance change data has a first level when a first voltage is applied to a pixel electrode of the display panel, and the display panel luminance change data has a second level higher than the first level when a second voltage lower than the first voltage is applied to the pixel electrode of the display panel, and wherein the light source luminance has a third level when the display panel luminance change data has the first level, and the light source luminance has a fourth level lower than the third level when the display panel luminance change data has the second level.

8. The method of claim 7, wherein a difference between the first level and the second level is substantially the same as a difference between the third level and the fourth level.

9. A method of driving a light source, the method comprising:

storing a display panel luminance change data indicating a luminance change of a display panel with respect to time;

outputting a light source driving signal, wherein the light source driving signal drives a light source part based on the display panel luminance change data so that a light source luminance outputted from the light source part is decreased when a display panel luminance is increased and the light source luminance is increased when the display panel luminance is decreased; and driving the light source part in response to the light source driving signal, wherein the display panel is in a normally black mode, wherein the display panel luminance change data has a fifth level when a first voltage is applied to a pixel electrode of the display panel, and the display panel luminance change data has a sixth level lower than the fifth level when a second voltage lower than the first voltage is applied to the pixel electrode of the display panel, and wherein the light source luminance has a seventh level when the display panel luminance change data has the fifth level, and the light source luminance has an eighth level higher than the seventh level when the display panel luminance change data has the sixth level.

10. The method of claim 9, wherein a difference between the fifth level and the sixth level is substantially the same as a difference between the seventh level and the eighth level.

11. A light source apparatus comprising:

a display panel luminance change data storing part configured to store a display panel luminance change data indicating a luminance change of a display panel with respect to time;

a light source part configured to providing light to the display panel and configured to output a light source luminance;

a light source driving part configured to drive the light source part based on the display panel luminance change data so that the light source luminance is decreased when a display panel luminance is increased and the light source luminance is increased when the display panel luminance is decreased;

a dimming data storing part configured to store a dimming data, the dimming data being converted from a data opposite to the display panel luminance change data by a pulse width modulation; and a timing control part configured to read the display panel luminance change data or the dimming data to output a dimming signal, wherein the dimming signal controls a luminance of the light source part, wherein the light source driving part comprises:

a switch operating in response to the dimming signal;

a first voltage terminal selectively connected to the light source part through the switch by the dimming signal, the first voltage terminal receiving a first voltage; and a second voltage terminal selectively connected to the light source part through the switch by the dimming signal, the second voltage terminal receiving a second voltage different from the first voltage.

12. The light source apparatus of claim 2, wherein the dimming signal is a digital signal and wherein the light source driving part includes a digital/analog converting part configured to convert the dimming signal to an analog dimming signal and configured to output the analog dimming signal.

13. The light source apparatus of claim 12, wherein the light source driving part includes a light source driving signal generating part configured to convert the analog dimming signal to the light source driving signal and configured to generate the light source driving signal.

14. A light source apparatus, comprising:

a display panel luminance change data storing part configured to store a display panel luminance change data indicating a luminance change of a display panel with respect to time a light source part configured to providing light to the display panel and configured to output a light source luminance; and a light source driving part configured to drive the light source part based on the display panel luminance change data so that the light source luminance is decreased when a display panel luminance is increased and the light source luminance in increased when the display panel luminance is decreased, wherein the light source part comprises:

a light source generating the light;

a switch electrically connected to the light source and operating in response to the light source driving signal;

a first resistor selectively connected to the light source through the switch by the light source driving signal; and a second resistor selectively connected to the light source through the switch by the light source driving signal, the second resistor having a resistance different from a resistance of the first resistor.

* * * * *